US006933088B2

(12) United States Patent
Yamada et al.

(10) Patent No.: US 6,933,088 B2
(45) Date of Patent: Aug. 23, 2005

(54) PHOTORECEPTOR OF ELECTROPHOTOGRAPHIC SYSTEM, PROCESS CARTRIDGE AND IMAGE FORMING APPARATUS

(75) Inventors: Wataru Yamada, Minamiashigara (JP); Kazuhiro Koseki, Minamiashigara (JP); Katsumi Nukada, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 5 days.

(21) Appl. No.: 10/417,187

(22) Filed: Apr. 17, 2003

(65) Prior Publication Data

US 2003/0232262 A1 Dec. 18, 2003

(30) Foreign Application Priority Data

Apr. 23, 2002 (JP) ..... 2002-121272

(51) Int. Cl.[7] ..... G03G 5/047
(52) U.S. Cl. ..... 430/58.2; 430/66
(58) Field of Search ..... 430/58.2, 66

(56) References Cited

U.S. PATENT DOCUMENTS

| | | | | |
|---|---|---|---|---|
| 6,146,800 | A * | 11/2000 | Yoshida et al. | 430/67 |
| 6,300,027 | B1 * | 10/2001 | Chambers et al. | 430/58.2 |
| 6,372,398 | B1 * | 4/2002 | Yamada et al. | 430/66 |
| 2003/0054271 | A1 * | 3/2003 | Yao et al. | 430/66 |

FOREIGN PATENT DOCUMENTS

| | | |
|---|---|---|
| JP | A 57-128344 | 8/1982 |
| JP | B2 60-22347 | 6/1985 |
| JP | A 63-65449 | 3/1988 |
| JP | A 4-15659 | 1/1992 |
| JP | B2 5-47104 | 7/1993 |
| JP | A 10-251277 | 9/1998 |
| JP | A 11-38656 | 2/1999 |
| JP | A 11-184106 | 7/1999 |
| JP | A 11-316468 | 11/1999 |

* cited by examiner

*Primary Examiner*—John L Goodrow
(74) *Attorney, Agent, or Firm*—Oliff & Berridge, PLC

(57) ABSTRACT

Provided are a photoreceptor of an electophotographic system satisfactorily high in resistance to contamination with a developer or corona products and durability to a contact electrification unit or a cleaning blade and capable of preventing occurrence of film defects in the production, and a process cartridge and an image forming apparatus in which a good image quality can be obtained over a long period of time. The photoreceptor includes a conductive substrate and a silicon compound-containing layer located on the substrate and containing a cyclic siloxane compound and/or derivatives thereof. The cyclic siloxane compound has a cyclic structure containing a repeating unit represented by formula (1)

(1)

wherein $A^1$ and $A^2$, which may be the same or different, each represent a monovalent organic group.

16 Claims, 2 Drawing Sheets

PHOTORECEPTOR OF ELECTROPHOTOGRAPHIC SYSTEM, PROCESS CARTRIDGE AND IMAGE FORMING APPARATUS

FIELD OF THE INVENTION

The present invention relates to a photoreceptor of an electophotographic system, a process cartridge and an image forming apparatus.

DESCRIPTION OF THE RELATED ART

In image forming apparatus such as a copying machine, a printer and a facsimile, an electophotographic system that conducts electrification, exposure, development and transfer using a photoreceptor has been widely employed. In such image forming apparatus, a high speed of an image forming process, improvement in image quality, downsizing and life prolongation of an apparatus, reduction in production cost and running cost and the like have been increasingly required. Further, with the recent development of technologies of computers, communication and the like, a digital system or a color image output system is being applied also to the image forming apparatus.

Under these circumstances, improvement in electrophotographic characteristics and durability, decrease in size and reduction in costs have been studied in photoreceptors of electrophotographic systems, and photoreceptors using various materials have been proposed.

For example, JP-A-63-65449 discloses a photoreceptor of an electrophotographic system in which silicone fine particles are added to a photoreceptive layer, describing that a lubricity is impaired to the surface of the photoreceptor by the addition of such silicone fine particles.

Further, a method is proposed in which in forming a photoreceptive layer, a low-molecular charge transport material is dispersed in a binder polymer or a polymer precursor and the binder polymer or the polymer precursor is then cured. JP-B-5-47104 and JP-B-60-22347 disclose a photoreceptor of an electrophotographic system using a silicone material as a binder polymer or a polymer precursor.

For improving mechanical strengths of a photoreceptor of an electrophotographic system, a protective layer is sometimes formed on a surface of a photoreceptive layer. As a material of the protective layer, a crosslinkable resin is used in many cases. However, since a protective layer formed of a crosslinkable resin becomes an insulating layer, photoelectric properties of the photoreceptor are impaired. Accordingly, a method in which a conductive metal oxide fine powder (JP-A-57-128344) or a charge transport material (JP-A-4-15659) is dispersed in a protective layer and a method in which a charge transport material having a reactive functional group is reacted with a thermoplastic resin to form a protective layer have been proposed.

Nevertheless, when the ordinary photoreceptors of electrophotographic systems are used in combination with an electrification unit of a contact electrification type (contact electrification unit) or a cleaning unit such as a cleaning blade, electrophotographic characteristics and durability are not necessarily satisfactory.

When the photoreceptor is combined with a contact electrification unit and a toner obtained by a chemical polymerization method (polymerization toner), the surface of the photoreceptor might be contaminated with corona products formed in the contact electrification or the polymerization toner remaining after the transfer step to decrease an image quality. When a cleaning blade is used to remove the corona products or the remaining toner adhered to the surface of the photoreceptor, a friction or an abrasion between the surface of the photoreceptor and the cleaning blade is increased, and scratch on the surface of the photoreceptor, break of the blade and warp of the blade tend to occur.

In the production of the photoreceptor of an electrophotographic system, in addition to the improvement in electrophotographic characteristics and durability, the reduction in production cost is a serious problem. However, the ordinary photoreceptors of electrophotographic systems are problematic in that film defects such as an orange peel and a granular structure are liable to occur in the production.

Meanwhile, the present applicant has found that the use of a charge transport material having a hydrolyzable silyl group improves the electrophotographic characteristics and the durability, and a photoreceptor of an electrophotographic system using the same is disclosed in JP-A-11-38656, JP-A-11-184106 and JP-A-11-316468. JP-A-10-251277 discloses a photoreceptor in which reactive siloxane oil is present in a film, and JP-A-11-38656 discloses a photoreceptor using a fluorine-containing coupling agent or PTFE. In these photoreceptor of an electrophotographic systems, however, there is stillroom for further improvement in electrophotographic characteristics and durability.

SUMMARY OF THE INVENTION

The invention has been made in view of the problems associated with the related art, and it aims to provide a photoreceptor of an electrophotographic system satisfactorily high in resistance to contamination with a developer or corona products and durability to a contact electrification unit or a cleaning blade and capable of preventing occurrence of film defects in the production, as well as a process cartridge and an image forming apparatus in which a good image quality can be obtained over a long period of time.

That is, the photoreceptor of an electrophotographic system of the invention includes a conductive substrate and a silicon compound-containing layer located on the substrate and containing a cyclic siloxane compound and/or derivatives thereof. The cyclic siloxane compound has a cyclic structure containing a repeating unit represented by formula (1)

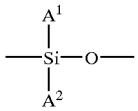

(1)

wherein $A^1$ and $A^2$, which may be the same or different, each represents a monovalent organic group.

The process cartridge of the invention includes the above photoreceptor and at least one of a developing unit which develops an electrostatic latent image formed on the photoreceptor to form a toner image and a cleaning unit which removes a toner remaining on the photoreceptor after transferring the toner image.

The image forming apparatus of the invention includes the above photoreceptor, an electrification unit which electrifies the photoreceptor, an exposure unit which exposes the electrified photoreceptor to form an electrostatic latent image, a developing unit which develops the electrostatic latent image to form a toner image, a transfer unit which transfers the toner image onto a transfer medium, and a cleaning unit which removes the toner remaining on the photoreceptor after transferring the toner image.

In the process cartridge and the image forming apparatus of the invention, the use of the photoreceptor of the invention can provide a good image quality over a long period of time.

BRIEF DESCRIPTION OF THE DRAWINGS

Preferred embodiments of the invention will be described in detail based on the following figures, wherein.

DESCRIPTION OF THE PREFERRED EMBODIMENTS

Figure 1:
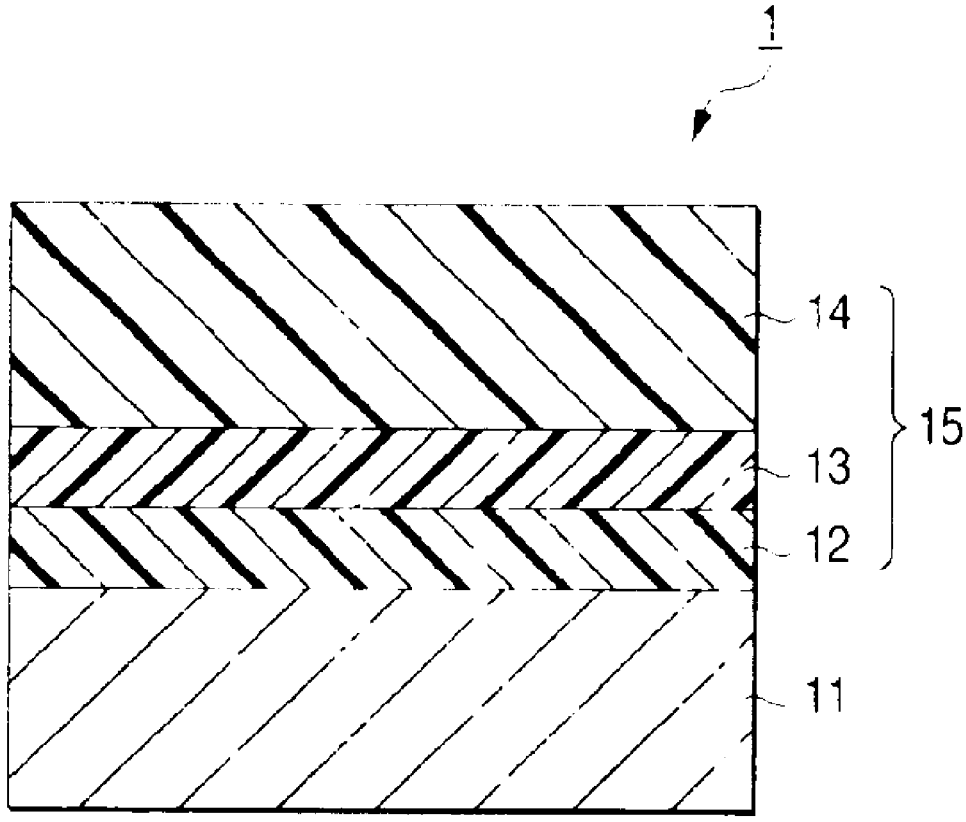
FIG. 1 is a schematic sectional view showing a preferable embodiment of a photoreceptor of an electrophotographic system of the invention.

The preferred embodiments of the invention are described in detail below by referring to the drawings. By the way, the same reference numerals are allotted to the same elements, and the repetition of the description is omitted.

The present inventors have assiduously conducted investigations to attain the aim, and have consequently found that since ordinary reactive siloxane oils (amino-modified polysiloxane, epoxy-modified polysiloxane, carboxyl-modified polysiloxane, carbinol-modified polysiloxane, methacryl-modified polysiloxane, mercapto-modified polysiloxane and phenol-modified polysiloxane) do not necessarily have a satisfactory reactivity and are hardly retained stably in a film by bonding, an effect of a resistance to contamination or the like is little maintained and that when unreacted siloxanes remain in a layer, a reactive terminal group of an unreacted substance tends to decrease electrical characteristics. On the basis of these findings, further studies have been made. Consequently, it has been found that when a cyclic siloxane compound having a specific structure is used and a silicon compound-containing layer containing the cyclic siloxane compound and/or the derivatives thereof is provided, a resistance to contamination, a durability, a film formability and the like of a photoreceptor of an electrophotographic system are satisfactorily increased. On this basis, the invention has been completed.

In the photoreceptor of an electrophotographic system of the invention, the silicon compound-containing layer containing the specific cyclic siloxane compound and/or the derivatives thereof is formed on the photoreceptive layer to satisfactorily increase photoelectric characteristics and mechanical strengths of the photoreceptor of an electrophotographic system. Such a cyclic siloxane compound is free from a reactive terminal group and reacted by its ring opening. Accordingly, even though the compound in an unreactive state is present in the layer, it does not have an adverse effect on the electrophotographic characteristics and the like. Further, owing to a high compatibility with a resin, the compound is stably retained in the layer to maintain the effect and improve a resistance to solvent cracking and flexibility. Therefore, characteristics of the photoreceptor of an electrophotographic system, such as a resistance to contamination with a developer or corona products and durability to a contact electrification unit or a cleaning blade can satisfactorily be improved, and further occurrence of film defects in the production can be prevented.

(Cyclic Siloxane Compound)

The cyclic siloxane compound used in the invention has a cyclic structure containing a repeating unit represented by formula (1)

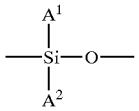

(1)

wherein $A^1$ and $A^2$, which may be the same or different, each represent a monovalent organic group.

Specific examples of the monovalent organic group represented by $A^1$ and $A^2$ in formula (1) include a linear or branched alkyl group, a cyclic alkyl group, an alkyl group containing a fluorine atom, such as a perfluoroalkyl group, a hydrogen atom, a substituted or unsubstituted aryl group, an alkylaryl group or an arylalkyl group. When at least one of $A^1$ and $A^2$ has a fluorine atom and/or a cyclic substituent (a cycloalkyl group, an alkylcycloalkyl group, an aryl group, an alkylaryl group or an arylalkyl group), a compatibility (dispersibility) with a resin is improved more. Thus, it is preferable. Especially when at least one of $A^1$ and $A^2$ has a fluorine atom, a resistance to contamination with a toner or corona products formed during an electrification step can be increased. Thus, it is more preferable.

The carbon number of $A^1$ and $A^2$ is not particularly limited unless electrophotographic characteristics are impaired. It is preferably from 1 to 20, more preferably from 1 to 10. When the carbon number of $A^1$ and $A^2$ is less than the lower limit, the compatibility with a silicon-free component tends to decrease. Meanwhile, when it exceeds the upper limit, the compatibility with a silicon-containing component tends to decrease.

The cyclic siloxane compound of the invention can be represented by, for example, formula (7)

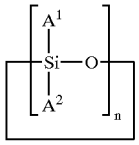

(7)

wherein $A^1$ and $A^2$, which may be the same or different, each represent a monovalent organic group, and n represents an integer.

In formula (7), the recurring units in n-numbers are not necessarily the same. The cyclic siloxane compound may be formed of two or more recurring units in which $A^1$ and $A^2$ are different. In case of two or more recurring units, the cyclic siloxane compound may be either a block copolymer or a random copolymer.

In formula (7), n is not particularly limited. It is preferably from 3 to 6. Among others, a cyclic siloxane compound with n being 3 or 4 has a higher reactivity, and can stably be retained particularly in a resin having a siloxane linkage through chemical bonding. Thus, it is preferable. When a cyclic siloxane compound with n being 5 or more is used, a resistance to contamination, a resistance to solvent cracking and flexibility are increased. Thus, it is preferable.

Specific examples of the cyclic siloxane compound represented by formula (7) include cyclo(dimethylsiloxanes) such as hexamethylcyclotrisiloxane, octamethylcyclotetrasiloxane, decamethylcyclopentasiloxane and dodecamethylcyclohexasiloxane, cyclo (methylphenylsiloxanes) such as 1,3,5-trimethyl-1,3,5-triphenylcyclotrisiloxane, 1,3,5,7-tetramethyl-1,3,5,7-tetraphenylcyclotetrasiloxane and 1,3,5,7,9-pentamethyl-1,3,5,7,9-pentaphenylcyclopentasiloxane, cyclo (diphenylsiloxanes) such as hexaphenylcyclotrisiloxane, fluorine-containing cyclosiloxanes such as 3-(3,3,3-trifluoropropyl)methylcyclotrisiloxane, hydrosilyl group-containing cyclosiloxanes such as methylhydrosiloxane mixtures, pentamethylcyclopentasiloxane and phenylhydrocyclosiloxane, and vinyl group-containing cyclosiloxanes such as pentavinylpentamethylcyclopentasiloxane. In addition to these compounds, desired cyclic siloxane compounds are synthesized by an ordinary method (for example, a method described in *Jikken Gakaku Kozai,* 4th edition, vol. 27, 373) and used.

The cyclic siloxane compound represented by formula (7) is made only of the recurring unit represented by formula (1). A cyclic siloxane compound in which a part or all of adjacent recurring units are bound via a divalent group is also available.

(Photoreceptor of an Electrophotographic System)

In the photoreceptor of an electrophotographic system of the invention, the silicon compound-containing layer containing the cyclic siloxane compound and/or the derivatives thereof is formed on the photoreceptive layer. The derivatives of the cyclic siloxane compound here referred to include a ring-opening polymer of the cyclic siloxane compound, a complex of the cyclic siloxane compound and a charge transport material and a complex of the cyclic siloxane compound and a resin or a resin precursor.

The photoreceptive layer provided in the photoreceptor of the invention may be a single-layer-type photoreceptive layer in which a charge generation material and a charge transport material are present in the same layer or a layered-type photoreceptive layer in which a layer containing a charge generation material (charge generation layer) and a layer containing a charge transport material (charge transport layer) are separately formed. The silicon compound-containing layer of the invention means a layer containing the cyclic siloxane compound and/or the derivatives thereof among a single-layer-type photoreceptive layer, a charge generation layer, a charge transport layer and a protective layer to be describe layer.

The photoreceptor of an electrophotographic system of the invention may be used either while the silicon compound-containing layer is still uncured or after the silicon compound-containing layer is cured, according to the purpose.

A preferred embodiment of the photoreceptor of an electrophotographic system of the invention is described in detail below upon taking a layered photoreceptor (laminated photoreceptor) as an example.

FIG. 1 is a schematic sectional view showing a preferred embodiment of a layered photoreceptor of the invention. In FIG. 1, an undercoat layer 12, a charge generation layer 13 and a charge transport layer 14 are laminated on a conductive substrate 11 in this order to form a photoreceptive layer 15. Of these, the charge transport layer 14 is the silicon compound-containing layer containing the cyclic siloxane compound of the invention.

Examples of the conductive substrate 11 include a metallic plate, a metallic drum and a metallic belt using a metal such as aluminum, copper, zinc, stainless steel, chromium, nickel, molybdenum, vanadium, indium, gold or platinum or an alloy thereof; and paper, a plastic film and a belt coated, deposited or laminated with a conductive compound such as a conductive polymer or indium oxide, a metal such as aluminum, palladium or gold or an alloy thereof. It is also possible to subject a surface of the substrate 11, as required, to surface treatment such as anodization coating, hot water oxidation, chemical treatment, coloration or irregular reflection treatment, for example, graining.

Specific examples of the binder resin used in the undercoat layer 12 include a polyamide resin, a vinyl chloride resin, a vinyl acetate resin, a phenol resin, a polyurethane resin, a melamine resin, a benzoguanamine resin, a polyimide resin, a polyethylene resin, a polypropylene resin, a polycarbonate resin, an acrylic resin, a methacrylic resin, a vinylidene chloride resin, a polyvinyl acetal resin, a vinyl chloride-vinyl acetate copolymer, a polyvinyl alcohol resin, a water-soluble polyester resin, nitrocellulose, casein, gelatin, polyglutamic acid, starch, starch acetate, amino starch, polyacrylic acid, polyacrylamide, a zirconium chelate compound, titanyl chelate compound, a titanyl alkoxide compound, an organotitanyl compound and a silane coupling agent. These may be used either singly or in combination. The binder resin may contain fine particles of titanium oxide, aluminum oxide, silicon oxide, zirconium oxide, barium titanate or a silicone resin.

As the coating method in forming the undercoat layer, an ordinary method such as a blade coating method, a Meyer bar coating method, a spray coating method, a dip-coating method, a bead coating method, an air knife coating method or a curtain coating method is employed. An appropriate thickness of the undercoat layer is from 0.01 to 40 $\mu$m.

Examples of the charge generation material contained in the charge generation layer 13 include various organic pigments and organic dyes such as an azo pigment, a quinone pigment, a perylene pigment, an indigo pigment, a thioindigo pigment, a bisbenzoimidazole pigment, a phthalocyanine pigment, a quinacridone pigment, a quinoline pigment, a lake pigment, an azo lake pigment, an anthraquinone pigment, an oxazine pigment, a dioxazine pigment, a triphenylmethane pigment, an azlenium dye, a squalium dye, a pyrylium dye, a triallylmethane dye, a xanthene dye, a thiazine dye and a cyanine dye; and inorganic materials such as amorphous silicon, amorphous selenium, tellurium, a selenium-tellurium alloy, cadmium sulfide, antimony sulfide, zinc oxide and zinc sulfide. Of these, a polycyclic aromatic pigment, a perylene pigment and an azo pigment are preferable in view of sensitivity, an electrical stability and a photochemical stability to irradiation light. These charge generation materials may be used either singly or in combination.

The charge generation layer 13 can be formed by coating a coating solution obtained by vacuum-depositing a charge generation material or dispersing a charge generation material in an organic solvent containing a binder resin. Examples of the binder resin in the charge generation layer include polyvinyl acetal resins such as a polyvinyl butyral resin, a polyvinyl formal resin and a partially acetalized polyvinyl acetal resin in which a part of butyral is modified with formal or acetoacetal, a polyamide resin, a polyester resin, a modified ether polyester resin, a polycarbonate resin, an acrylic resin, a polyvinyl chloride resin, a polyvinylidene chloride resin, a polystyrene resin, a polyvinyl acetate resin, a vinyl chloride-vinyl acetate copolymer, a silicone resin, a phenol resin, a phenoxy resin, a melamine resin, a benzoguanamine resin, a urea resin, a polyurethane resin, a poly-N-vinylcarbazole resin, a polyvinylanthracene resin and polyvinylpyrene. These can be used either singly or in combination. When a polyvinyl acetal resin, a vinyl chloride-vinyl acetate copolymer, a phenoxy resin and a modified ether polyester resin among these resins are used, a dispersibility of the charge generation material is improved, and a long-term stable coating solution is obtained without coagulating the charge generation material. The use of such a coating solution can form a uniform film easily and surely to improve electrical characteristics and prevent occurrence of an image quality defect. A charge generation material to binder resin mixing ratio is preferably in the range of from 5:1 to 1:2 in terms of a volume ratio.

Examples of a solvent used in preparing the coating solution include organic solvents such as methanol, ethanol, n-propanol, n-butanol, benzyl alcohol, methyl cellosolve, ethyl cellosolve, acetone, methyl ethyl ketone, cyclohexanone, chlorobenzene, methyl acetate, n-butyl acetate, dioxane, tetrahydrofuran, methylene chloride and chloroform. These can be used either singly or in combination.

As a method for coating the coating solution, methods listed on the undercoat layer are available. The thickness of the thus-formed charge generation layer 13 is preferably from 0.01 to 5 $\mu$m, more preferably from 0.1 to 2 $\mu$m. When the thickness of the charge generation layer 12 is less than 0.01 $\mu$m, it is hard to uniformly form the charge generation layer. Meanwhile, when the thickness exceeds 5 $\mu$m, electrophotographic characteristics tend to drastically decrease.

It is also possible to add a stabilizer such as an antioxidant or a deactivator to the charge generation layer 13. Examples of the antioxidant include phenol, sulfur, phosphorus and amine compounds. Examples of the deactivator include bis(dithiobenzyl)nickel and nickel di-n-butylthiocarbamate.

The charge transport layer 14 contains, as stated above, the cyclic siloxane compound of the invention, and this cyclic siloxane compound can be formed by being mixed with a charge transport material, a binder resin, a crosslinking agent, fine particles and additives.

Examples of the low-molecular charge transport material include pyrene, carbazole, hydrazone, oxazole, oxadiazole, pyrazoline, arylamine, arylmethane, benzidine, thaizole, stilbene and butadiene compounds. Examples of the high-molecular charge transport material include poly-N-vinylcarbazole, halogenated poly-N-vinylcarbazole, polyvinylpyrene, polyvinylanthracene, polyvinylacridine, a pyrene-formaldehyde resin, an ethylcarbazole-formaldehyde resin, a triphenylmethane polymer and polysilane. Of these, a triphenylamine compound, a triphenylmethane compound and a benzidine compound are preferable in view of a mobility, a stability and a light transparency.

As the charge transport material in combination with the cyclic siloxane compound of the invention, a compound represented by formula (4) is especially preferable.

$$F^1[-D^1\text{-}SiQ^3{}_cR^3{}_{3-c}]_d \quad (4)$$

wherein $F^1$ represents an organic group derived from a compound having a hole transportability, $R^3$ represents one selected from the group consisting of a hydrogen atom, an alkyl group and a substituted or unsubstituted aryl group, $D^1$ represents a divalent group, $Q^3$ represents a hydrolyzable group, c represents an integer of from 1 to 3, and d represents an integer of from 1 to 4.

In formula (4), the organic group represented by $F^1$ is not particularly limited so long as it has a hole transportability. Preferable is an organic group represented by formula (6)

(6)

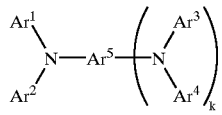

wherein $Ar^1$, $Ar^2$, $Ar^3$ and $Ar^4$, which may be the same or different, each represent a substituted or unsubstituted aryl group, $Ar^5$ represents a substituted or unsubstituted aryl group or arylene group, and k represents 0 or 1, provided at least one of $Ar^1$ to $Ar^5$ has a bonding site with $-D^1\text{-}SiQ^3{}_cR^3{}_{3-c}$ in formula (4).

In formula (6), $Ar^1$ to $Ar^4$ are preferably any of formulas (8) to (14).

(8)

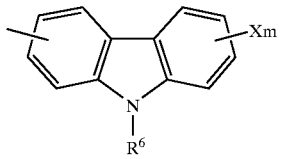

(9)

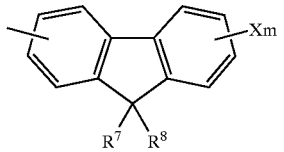

(10)

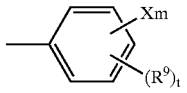

(11)

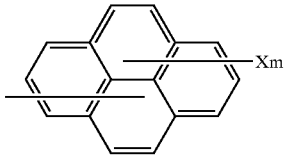

(12)

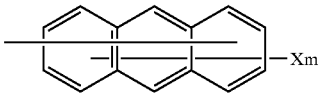

(13)

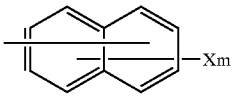

(14)

wherein $R^6$ represents one selected from the group consisting of a hydrogen atom, an alkyl group having from 1 to 4 carbon atoms, a phenyl group substituted with an alkyl group having from 1 to 4 carbon atoms or an alkoxy group having from 1 to 4 carbon atoms, an unsubstituted phenyl group and an aralkyl group having from 7 to 10 carbon atoms, $R^7$ to $R^9$ each represent one selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms and a halogen atom, Ar represents a substituted or unsubstituted arylene group, X represents $-D^1\text{-}SiQ^3{}_cR^3{}_{3-c}$ in formula (4), m and s each represent 0 or 1, q and r each represent an integer of from 1 to 10, and t and t' each represent an integer of from 1 to 3.

Ar in formula (14) is preferably a group represented by formula (15) or (16).

(15)

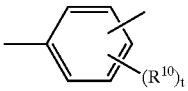

(16)

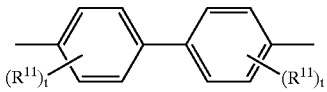

wherein $R^{10}$ and $R^{11}$ each represent one selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms and a halogen atom, and t is an integer of from 1 to 3.

In formula (14), Z' is preferably a group represented by any of formulas (17) to (24).

(17)

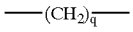

(18)

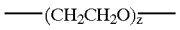

(19)

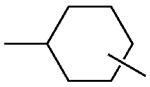

(20)

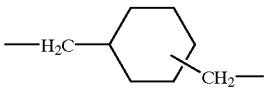

(21)

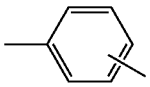

(22)

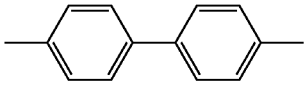

(23)

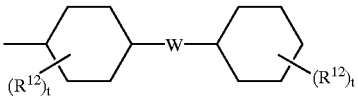

(24)

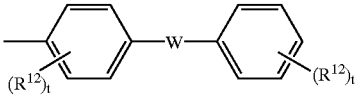

wherein $R^{12}$ and $R^{13}$ each represent one selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms and a halogen atom, W represents a divalent group, q and r each represent an integer of from 1 to 10, and t represents an integer of from 1 to 3.

In formulas (23) and (24), W is preferably any of divalent groups represented by formulas (25) to (33).

(25)

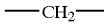

(26)

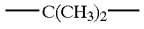

(27)

(28)

(29)

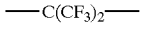

(30)

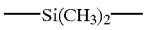

(31)

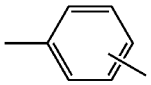

(32)

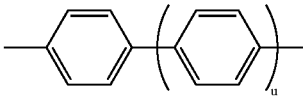

(33)

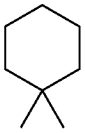

wherein u represents an integer of from 0 to 3.

In formula (4), $Ar^5$ is an aryl group shown in $Ar^1$ to $Ar^4$ when k is 0 or an arylene group in which a predetermined hydrogen atom is removed from such an aryl group when k is 1.

In formula (4), preferable examples of the divalent group represented by $D^1$ include divalent hydrocarbon groups represented by $—C_nH_{2n}—$, $C_nH_{2n-2}—$, $—C_nH_{2n-4}—$ (n is an integer of from 1 to 15, preferably an integer of from 2 to 10), $—CH_2—C_6H_4—$ and $—C_6H_4—C_6H_4—$, an oxycarbonyl group (—COO—), a thio group (—S—), an oxy group (—O—), an isocyano group (—N═CH—) and a divalent group of a combination of two or more of these groups. These divalent groups may have a substituent such as an alkyl group, a phenyl group, an alkoxy group or an amino group in the side chain. When D is the preferable divalent group, strengths of the layer tend to be increased by imparting an appropriate flexibility to an organosilicate structure.

In formula (4), $R^3$ represents, as described above, a hydrogen atom, an alkyl group (preferably an alkyl group having from 1 to 5 carbon atoms), or a substituted or unsubstituted aryl group (preferably a substituted or unsubstituted aryl group having from 6 to 15 carbon atoms).

In formula (4), the hydrolyzable group represented by $Q^3$ refers to a functional group capable of forming a siloxane linkage (O—Si—O) by hydrolysis in a curing reaction of the compound represented by formula (1). Specific examples of the hydrolyzable group in the invention include a hydroxyl group, an alkoxy group, a methyl ethyl ketoxime group, a diethylamino group, an acetoxy group, a propenoxy group and a chloro group. Of these, a group represented by —OR" (R" is an alkyl group having from 1 to 15 carbon atoms or a trimethylsilyl group) is preferable.

Preferable examples of a combination of groups represented by $Ar^1$, $Ar^2$, $Ar^3$, $Ar^4$, $Ar^5$ and $D\text{-}SiR^3_{3-c}Q^3_c$ and an integer k are shown in Tables 1 to 4. In these tables, S represent $D\text{-}SiR^3_{3-c}Q^3_c$ bound to $Ar^1$ to $Ar^5$, Me represents a methyl group, Et represents an ethyl group, and Pr represents a propyl group.

TABLE 1
| No. | Ar1 | Ar2 | Ar3 | Ar4 | Ar5 | k | —S |
|---|---|---|---|---|---|---|---|
| V-1 | 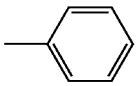 | 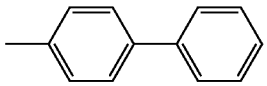 | — | — | 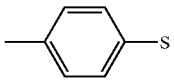 | 0 | —$(CH_2)_4$—Si(OiPr)$_3$ |
| V-2 | 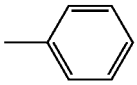 | 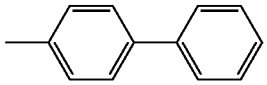 | — | — | 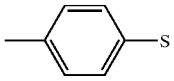 | 0 | —$(CH_2)_4$—Si(OEt)$_3$ |
| V-3 | 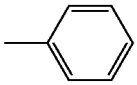 | 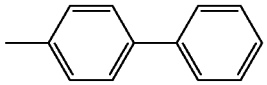 | — | — | 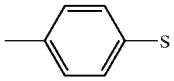 | 0 | —$(CH_2)_4$—Si(OMe)$_3$ |
| V-4 | 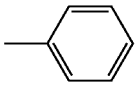 | 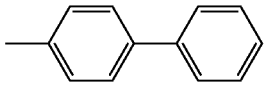 | — | — | 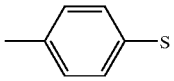 | 0 | —$(CH_2)_4$—SiMe(OMe)$_3$ |
| V-5 | 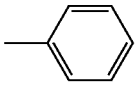 | 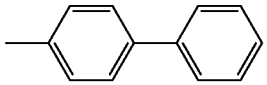 | — | — | 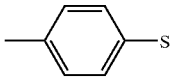 | 0 | —$(CH_2)_4$—SiMe(OiPr)$_2$ |
| V-6 | 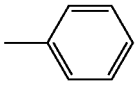 | 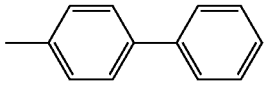 | — | — | 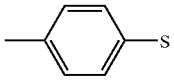 | 0 | —CH═CH—$(CH_2)_2$—Si(OiPr)$_3$ |
| V-7 | 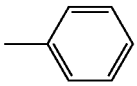 | 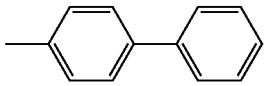 | — | — | 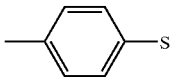 | 0 | —CH═CH—$(CH_2)_2$—Si(OMe)$_3$ |
| V-8 | 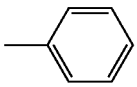 | 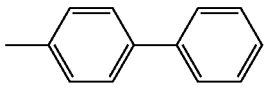 | — | — | 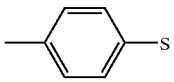 | 0 | —CH═N—$(CH_2)_3$—Si(OiMe)$_3$ |
| V-9 | 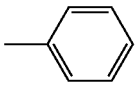 | 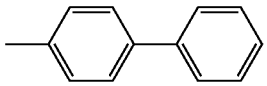 | — | — | 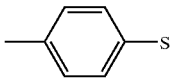 | 0 | —CH═N—$(CH_2)_3$—Si(OiPr)$_3$ |
| V-10 | 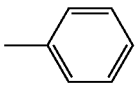 | 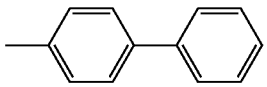 | — | — | 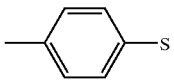 | 0 | —O—$(CH_3)_3$—Si(OiPr)$_3$ |
| V-11 | 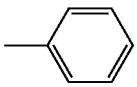 | 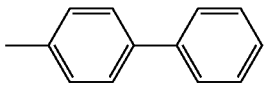 | — | — | 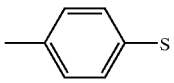 | 0 | —COO—$(CH_2)_3$—Si(OiPr)$_3$ |
| V-12 | 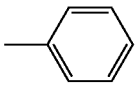 | 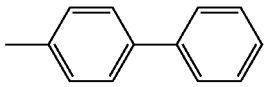 | — | — | 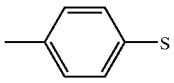 | 0 | —$(CH_2)_2$—COO—$(CH_2)_3$—Si(OiPr)$_3$ |
| V-13 | 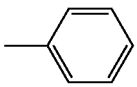 | 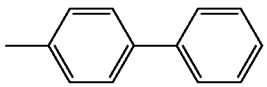 | — | — | 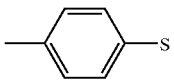 | 0 | —$(CH_2)_2$—COO—$(CH_2)_3$—Si(OiPr)$_2$Me |
| V-14 | 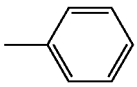 | 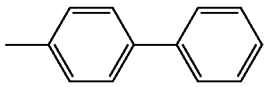 | — | — | 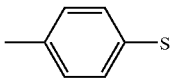 | 0 | —$(CH_2)_2$—COO—(CHphd 2)$_3$—Si(OiPr)Me$_2$ |

TABLE 1-continued
| No. | Ar1 | Ar2 | Ar3 | Ar4 | Ar5 | k | —S |
|---|---|---|---|---|---|---|---|
| V-15 | 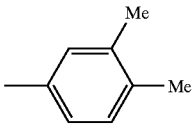 | 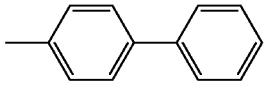 | — | — | 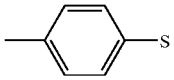 | 0 | —$(CH_2)_4$—Si$(OMe)_3$ |
TABLE 2
| No. | Ar1 | Ar2 | Ar3 | Ar4 |
|---|---|---|---|---|
| V-16 | 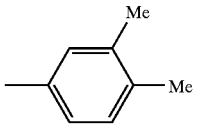 | 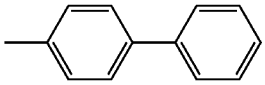 | — | — |
| V-17 | 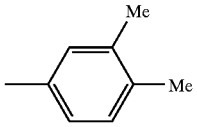 | 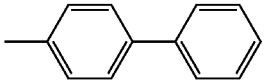 | — | — |
| V-18 | 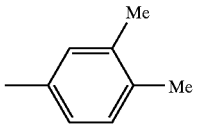 | 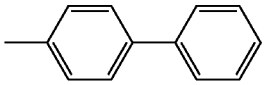 | — | — |
| V-19 | 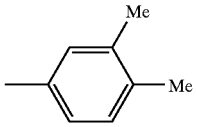 | 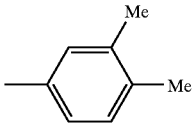 | — | — |
| V-20 | 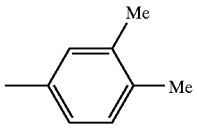 | 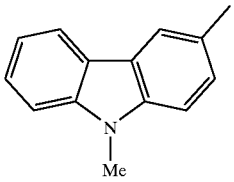 | — | — |
| V-21 | 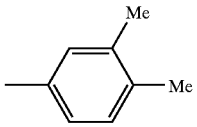 | 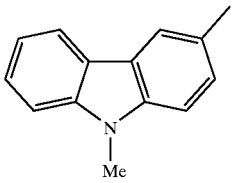 | — | — |
| V-22 | 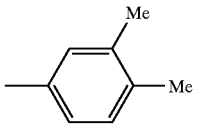 | 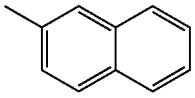 | — | — |
| V-23 | 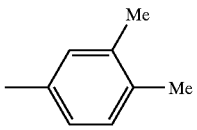 | 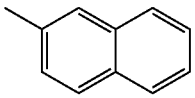 | — | — |

TABLE 2-continued
| | | | | |
|---|---|---|---|---|
| V-24 | 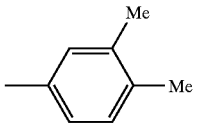 | 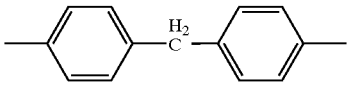 | — | — |
| V-25 | 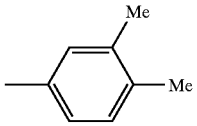 | 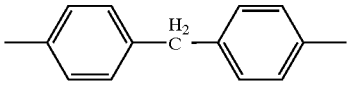 | — | — |
| V-26 | 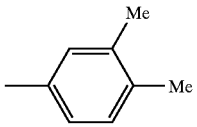 | 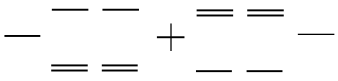 | — | — |
| V-27 | 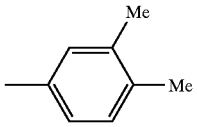 | 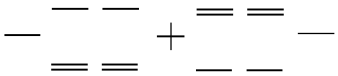 | — | — |
| V-28 | 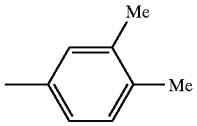 | 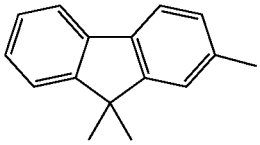 | — | — |
| V-29 | 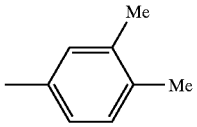 | 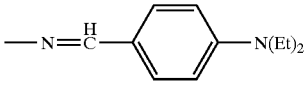 | — | — |
| V-30 | 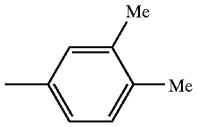 | 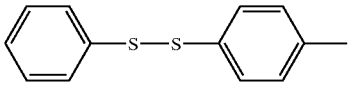 | — | — |
| No. | Ar5 | k | —S |
|---|---|---|---|
| V-16 | 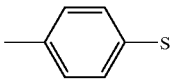 | 0 | —$(CH_2)_2$—COO—$(CH_2)_3$—Si(OiPr)$_3$ |
| V-17 | 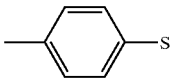 | 0 | —$(CH_2)_2$—COO—$(CH_2)_3$—SiMe(OiPr)$_3$ |
| V-18 | 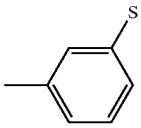 | 0 | —O—$(CH_2)_3$—Si(OiPr)$_3$ |
| V-19 | 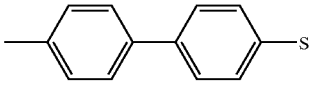 | 0 | —COO—$(CH_2)_3$—Si(OiPr)$_3$ |
| V-20 | 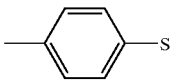 | 0 | —$(OH_3)_4$—Si(OiPr)$_3$ |

TABLE 2-continued
| | | | |
|---|---|---|---|
| V-21 | 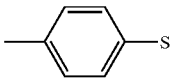 | 0 | —$(OH_2)_2$—COO—$(CH_2)_3$—Si(OiPr)$_3$ |
| V-22 | 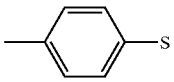 | 0 | —$(CH_2)_4$—Si(OiPr)$_3$ |
| V-23 | 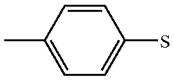 | 0 | —$(CH_2)_2$—COO—$(CH_2)_3$—Si(OiPr)$_3$ |
| V-24 | 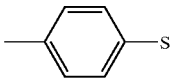 | 0 | —$(CH_2)_4$—Si(OiPr)$_3$ |
| V-25 | 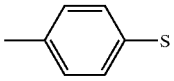 | 0 | —$(CH_2)_2$—COO—$(CH_2)_3$—Si(OiPr)$_3$ |
| V-26 | 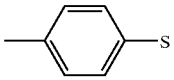 | 0 | —$(CH_2)_4$—Si(OiPr)$_3$ |
| V-27 | 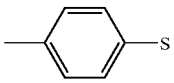 | 0 | —$(CH_2)_2$—COO—$(CH_2)_3$—Si(OiPr)$_3$ |
| V-28 | 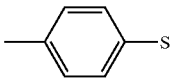 | 0 | —$(CH_2)_2$—COO—$(CH_2)_3$—Si(OiPr)$_3$ |
| V-29 | 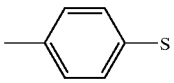 | 0 | —$(CH_2)_2$—COO—$(CH_2)_3$—Si(OiPr)$_3$ |
| V-30 | 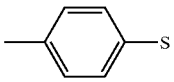 | 0 | —$(CH_2)_2$—COO—$(CH_2)_3$—Si(OiPr)$_3$ |
TABLE 3
| No. | Ar1 | Ar2 | Ar3 | Ar4 |
|---|---|---|---|---|
| V-31 | 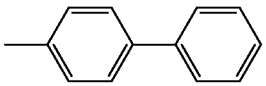 | 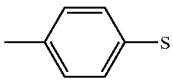 | — | — |
| V-32 | 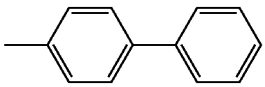 | 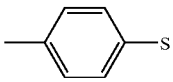 | — | — |
| V-33 | 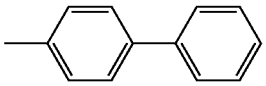 | 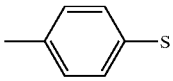 | — | — |
| V-34 | 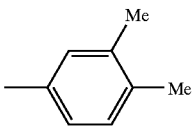 | 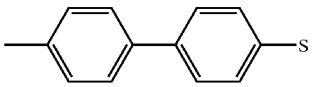 | — | — |

TABLE 3-continued
| | | | | |
|---|---|---|---|---|
| V-35 | 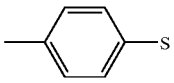 | 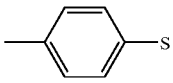 | — | — |
| V-36 | 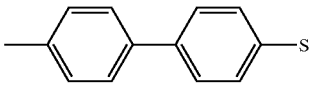 | 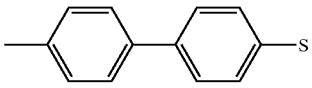 | — | — |
| V-37 | 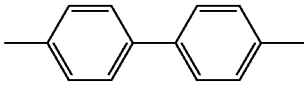 | 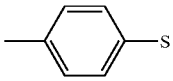 | 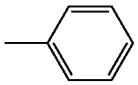 | 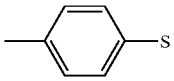 |
| V-38 | 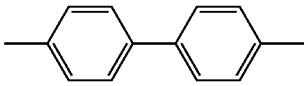 | 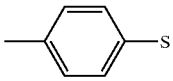 | 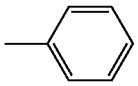 | 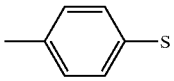 |
| V-39 | 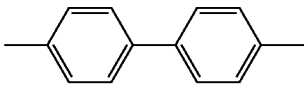 | 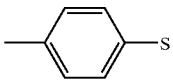 | 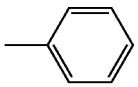 | 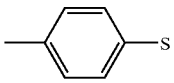 |
| V-40 | 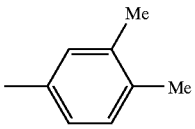 | 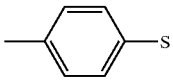 | 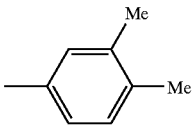 | 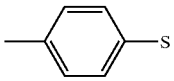 |
| V-41 | 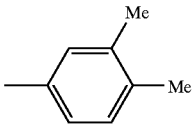 | 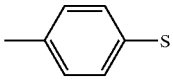 | 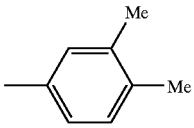 | 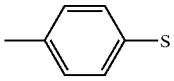 |
| V-42 | 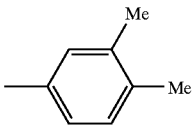 | 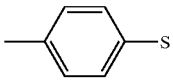 | 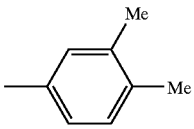 | 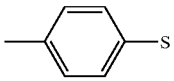 |
| V-43 | 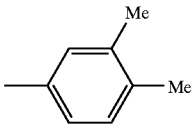 | 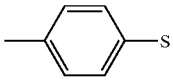 | 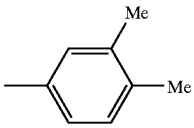 | 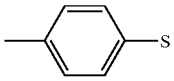 |
| V-44 | 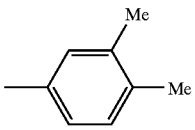 | 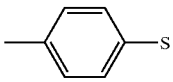 | 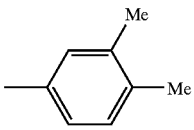 | 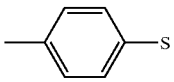 |
| V-45 | 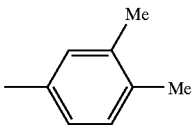 | 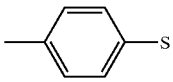 | 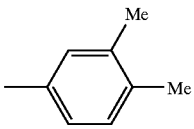 | 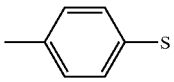 |
| No. | Ar5 | k | —S |
|---|---|---|---|
| V-31 | 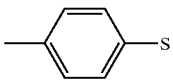 | 0 | $—(CH_2)_2—COO—(CH_2)_3—Si(OiPr)_3$ |
| V-32 | 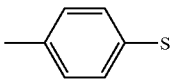 | 0 | $—(CH_2)_2—COO—(CH_2)_3—Si(OiPr)_2Me$ |

TABLE 3-continued
| | | | |
|---|---|---|---|
| V-33 | 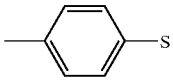 | 0 | —$(CH_2)_2$—COO—$(CH_2)_3$—Si(OiPr)$Me_2$ |
| V-34 | 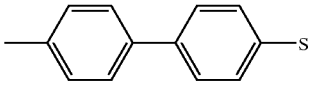 | 0 | —COO—$(CH_2)_3$—Si$(OiPr)_3$ |
| V-35 | 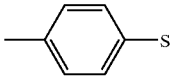 | 0 | —$(CH_2)_2$—COO—$(CH_2)_3$—Si$(OiPr)_3$ |
| V-36 | 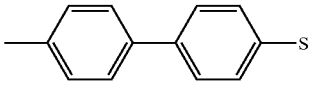 | 0 | —COO—$(CH_2)_3$—Si$(OiPr)_3$ |
| V-37 | 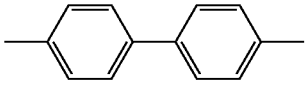 | 1 | —$(CH_2)_4$—Si$(OEt)_3$ |
| V-38 | 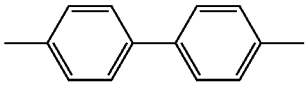 | 1 | —$(CH_2)_4$—Si$(OiPr)_3$ |
| V-39 | 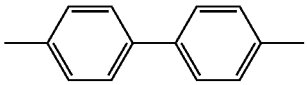 | 1 | —CH═CH—$(CH_2)_2$—Si$(OiPr)_3$ |
| V-40 | 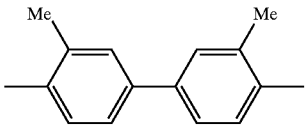 | 1 | —$(CH_2)_4$—Si$(OMe)_3$ |
| V-41 | 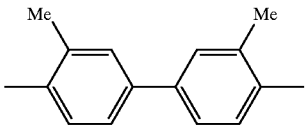 | 1 | —$(CH_2)_4$—Si$(OiPr)_3$ |
| V-42 | 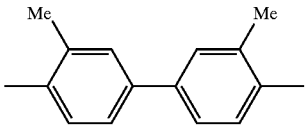 | 1 | —CH═CH—$(CH_2)_2$—Si$(OiPr)_3$ |
| V-43 | 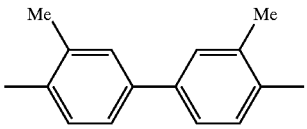 | 1 | —CH═N—$(CH_2)_3$—Si$(OiPr)_3$ |
| V-44 | 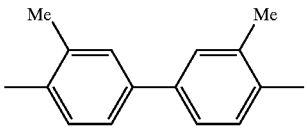 | 1 | —O—$(CH_2)_2$—Si$(OiPr)_3$ |
| V-45 | 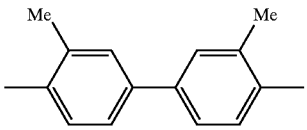 | 1 | —COO—$(CH_2)_2$ —Si$(OiPr)_3$ |

TABLE 4
| No. | Ar1 | Ar2 | Ar3 | Ar4 |
|---|---|---|---|---|
| V-46 | 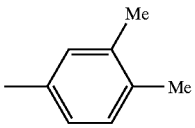 | 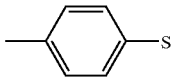 | 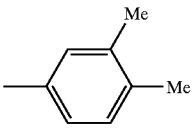 | 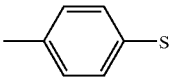 |
| V-47 | 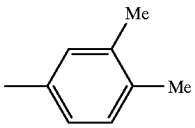 | 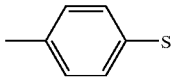 | 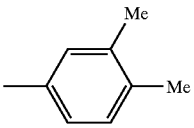 | 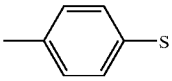 |
| V-48 | 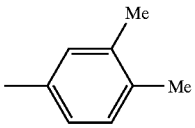 | 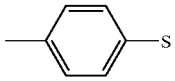 | 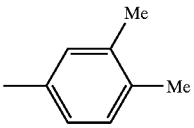 | 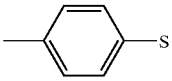 |
| V-49 | 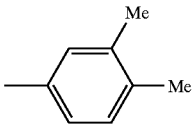 | 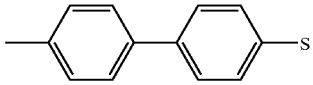 | 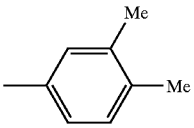 | 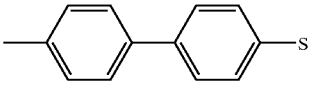 |
| V-50 | 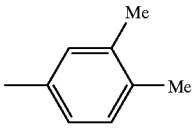 | 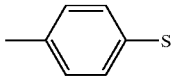 | 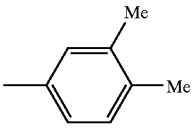 | 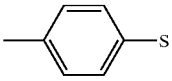 |
| V-51 | 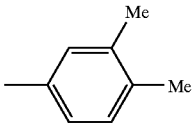 | 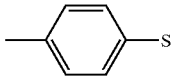 | 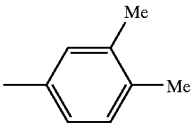 | 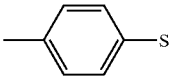 |
| V-52 | 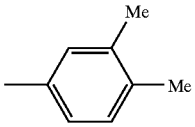 | 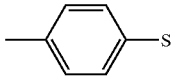 | 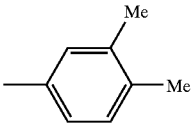 | 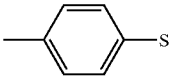 |
| V-53 | 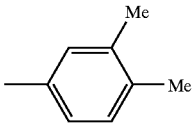 | 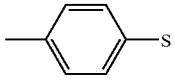 | 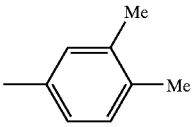 | 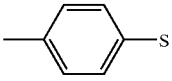 |
| V-54 | 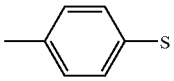 | 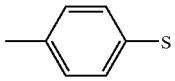 | 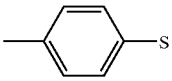 | 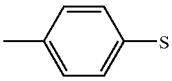 |
| V-55 | 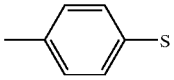 | 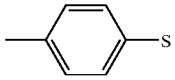 | 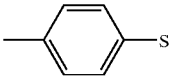 | 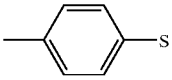 |
| V-56 | 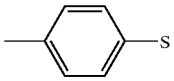 | 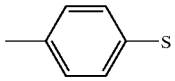 | 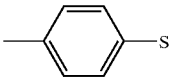 | 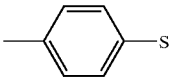 |
| V-57 | 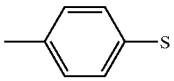 | 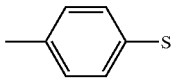 | 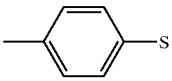 | 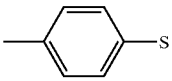 |

TABLE 4-continued
| | | | | |
|---|---|---|---|---|
| V-58 | 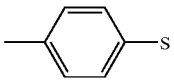 | 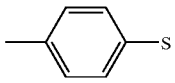 | 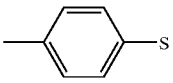 | 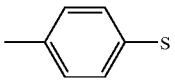 |
| V-59 | 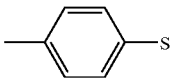 | 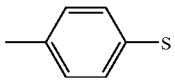 | 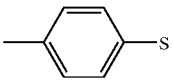 | 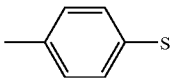 |
| V-60 | 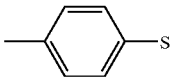 | 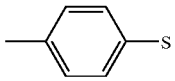 | 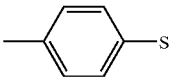 | 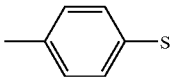 |
| V-61 | 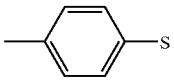 | 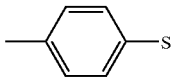 | 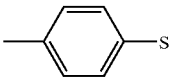 | 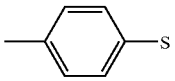 |
| No. | Ar5 | k | —S |
|---|---|---|---|
| V-46 | 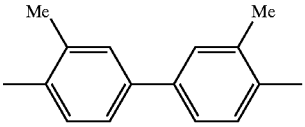 | 1 | —$(CH_2)_2$—COO—$(CH_2)_3$—Si(OiPr)$_3$ |
| V-47 | 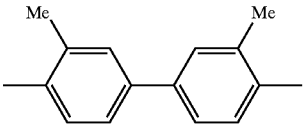 | 1 | —$(CH_2)_2$—COO—$(CH_2)_3$—Si(OiPr)$_3$Me |
| V-48 | 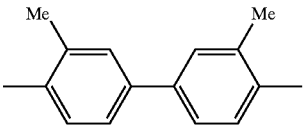 | 1 | —$(CH_2)_2$—COO—$(CH_2)_3$—Si(OiPr)$_3$Me2 |
| V-49 | 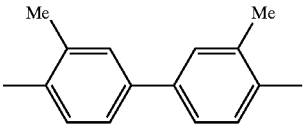 | 1 | —COO—$(CH_2)_3$—Si(OiPr)$_3$ |
| V-50 | 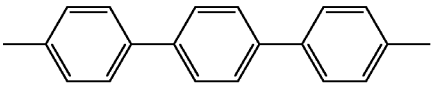 | 1 | —$(CH_2)_4$—Si(OiPr)$_3$ |
| V-51 | 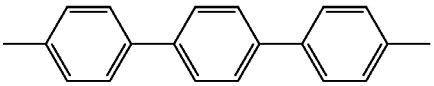 | 1 | —CH═CH—$(CH_2)_2$—Si(OiPr)$_3$ |
| V-52 | 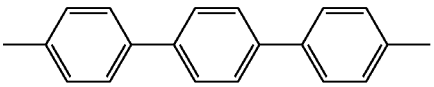 | 1 | —$(CH_2)_2$—COO—$(CH_2)_3$—Si(OiPr)$_3$ |
| V-53 | 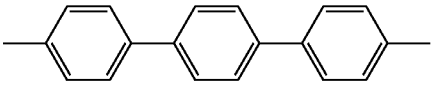 | 1 | —$(CH_2)_2$—COO—$(CH_2)_3$—Si(OiPr)$_3$Me |
| V-54 | 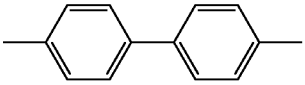 | 1 | —COO—$(CH_2)_3$—Si(OiPr)$_3$ |
| V-55 | 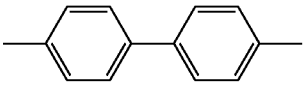 | 1 | —$(CH_2)_2$—COO—$(CH_2)_3$—Si(OiPr)$_3$ |

TABLE 4-continued

| | | | |
|---|---|---|---|
| V-56 | 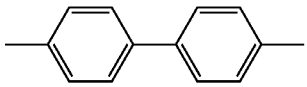 | 1 | —$(CH_2)_2$—COO—$(CH_2)_3$—Si(OiPr)$_3$Me |
| V-57 | 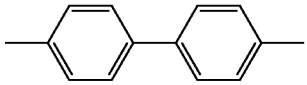 | 1 | —$(CH_2)_2$—COO—$(CH_2)_3$—Si(OiPr)$_3$Me$_2$ |
| V-58 | 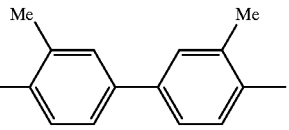 | 1 | —COO—$(CH_2)_3$—Si(OiPr)$_3$ |
| V-59 | 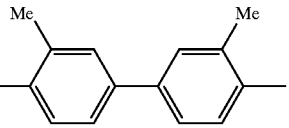 | 1 | —$(CH_2)_2$—COO—$(CH_2)_3$—Si(OiPr)$_3$ |
| V-60 | 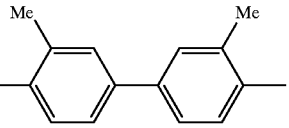 | 1 | —$(CH_2)_2$—COO—$(CH_2)_3$—Si(OiPr)$_2$Me |
| V-61 | 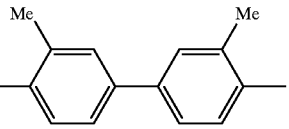 | 1 | —$(CH_2)_2$—COO—$(CH_2)_3$—Si(OiPr)$_3$Me$_2$ |

A binder resin used in the charge transport layer 14 is preferably a high polymer capable of forming an electrical insulating film. Examples of the high polymer include a polycarbonate, a polyester, a methacrylic resin, an acrylic resin, polyvinyl chloride, polyvinylidene chloride, polystyrene, polyvinyl acetate, a styrene-butadiene copolymer, a vinylidene chloride-acrylonitrile polymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, a poly-N-vinylcarbazole, polyvinyl butyral, polyvinyl formal, polystyrene, casein, gelatin, polyvinyl alcohol, ethyl cellulose, a phenol resin, a polyamide, carboxymethyl cellulose, a vinylidene chloride polymer latex and polyurethane. These can be used either singly or in combination. Of these high polymers, a polycarbonate, a polyester, a methacrylic resin and an acrylic resin are preferable because a compatibility with a charge transport material, a solubility in a solvent and strength are excellent.

When the cyclic siloxane compound of the invention is liquid, it can be mixed with the charge transport material and the binder resin either as such or by being dissolved in a predetermined solvent. When the cyclic siloxane compound is solid, it can be mixed therewith either by being dissolved in a predetermined solvent or by being finely divided and then dispersed in a predetermined solvent.

It is advisable that in addition to the hydrolyzable organosilicon compound represented by formula (4), a compound capable of forming a bond with this compound is mixed, because various properties such as a lubricity and an adhesion can be varied. The bond referred to in the invention means all bonds which are stronger than a hydrogen bond. Such a compound can be used at any ratio unless characteristics such as a film formability and electrical characteristics are decreased. Specific examples thereof can include various silane coupling agents and commercial silicon-containing hard coating agents.

Examples of the silane coupling agents include tetrafunctional alkoxysilanes such as tetramethoxysilane and tetraethoxysilane; trifunctional alkoxysilanes such as methyltrimethoxysilane, methyltriethoxysilane, ethyltrimethoxysilane, methyltrimethoxyethoxysilane, vinyltrimethoxysilane, vinyltriethoxysilane, phenyltrimethoxysilane, γ-glycidoxypropylmethyldiethoxysilane, γ-glycidoxypropyltrimethoxysilane, γ-glycidoxypropyltrimethoxysilane, γ-aminopropyltriethoxysilane, γ-aminopropyltrimethoxysilane, γ-aminopropylmethyldimethoxysilane and N-β(aminoethyl) γ-aminopropyltriethoxysilane; difunctional alkoxysilanes such as dimethyldimethoxysilane and diphenyldimethoxysilane; and monofunctional alkoxysilanes such as trimethylmethoxysilane. For improving strengths of a film, trifunctional and tetrafunctional alkoxysilanes are preferable. For improving a flexibility and a film-formability, monofunctional and difunctional alkoxysilanes are preferable.

Examples of the commercial hard coating agents can include KP-85, X-40-9740 and X-40-2239 (made by Shinetsu Silicone), and AY42-440, AY42-441 and AY49-208 (made by Toray Dow Corning). For imparting a water repellency, a fluorine-containing compound may be added. Examples thereof include (tridecafluoro-1,1,2,2-tetrahydrooctyl)triethoxysilane, (3,3,3-trifluoropropyl) trimethoxysilane, 3-(heptafluoroisopropoxy) propyltriethoxysilane, 1H,1H,2H,2H-perfluoroalkyltriethoxysilane, 1H,1H,2H,2H-perfluorodecyltriethoxysilane and 1H,1H,2H,2H-perfluorooctyltriethoxysilane. The amount of the fluorine-containing compound is preferably 0.5 or less by weight based on the fluorine-free compound. When it exceeds this value, a crosslinked film might be problematic in a film formability.

An organosilicon compound represented by formula (3) is preferably used, $$B(—SiQ^2_bR^2_{3-b})_2 \quad (3)$$

wherein $R^2$ represents one selected from the group consisting of a hydrogen atom, an alkyl group and a substituted or unsubstituted aryl group, $Q^2$ represents a hydrolyzable group, B represents a divalent organic group, and b represents an integer of from 1 to 3.

Preferable examples of the compound represented by (3) are listed in Table 5.

TABLE 5

| No. | Structural formula |
|---|---|
| III-1 | $(MeO)_3Si—(CH_2)_2—Si(OMe)_3$ |
| III-2 | $(MeO)_2Me—(CH_2)_2—SiMe(OMe)_2$ |
| III-3 | $(MeO)_2MeSi—(CH_2)_2—SiMe(OMe)_2$ |
| III-4 | $(MeO)_2Si—(CH_2)_2—Si(OMe)_2$ |
| III-5 | $(EtO)_3Si—(CH_2)_3—Si(OEt)_3$ |
| III-6 | $(MeO)_2MeSi—(CH_2)_{10}—SiMe(OMe)_2$ |
| III-7 | $(MeO)_3Si—(CH_2)_3—NH—(CH_2)_3—Si(OMe)_3$ |
| III-8 | $(MeO)_2Si—(OH2)_3—NH—(CH_2)_2—NH—(CH_2)_3—Si(OMe)_3$ |
| III-9 | 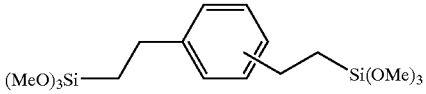 |
| III-10 | 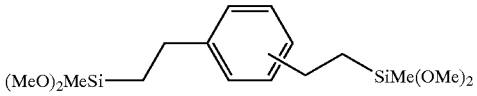 |
| III-11 | 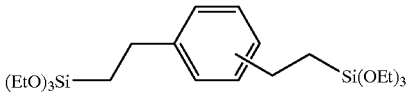 |
| III-12 | 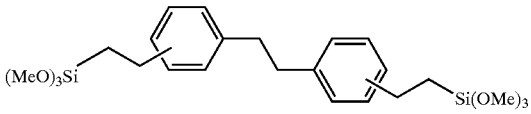 |
| III-13 | 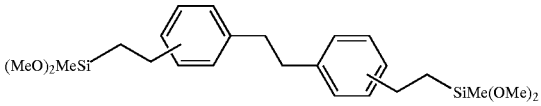 |
| III-14 | 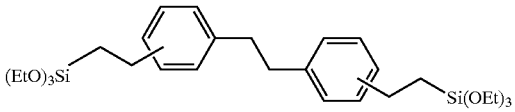 |
| III-15 | $(MeO)_3SiO_2H_3—O—CH_2CH[—O—C_3H_3Si(OMe)_3]—CH_2[—O—C_3H_3Si(OMe)_3]$ |
| III-16 | $(MeO)_2SiO_2H_4—SiMe_2—O—SiMe_2—O—SiMe_2—C_2H_4Si(OMe)_3$ |

For improving a resistance to adhesion with a contaminant and a lubricity on the surface of the photoreceptor, it is possible to add various fine particles. These can be used either singly or in combination. Such fine particles can be, for example, silicon-containing fine particles. The silicon-containing fine particles are fine particles containing silicon as a constituent element. Specific examples thereof include colloidal silica and silicone fine particles.

The colloidal silica used as the silicon-containing fine particles in the invention is selected from an acid or alkaline aqueous dispersion having an average particle diameter of from 1 to 100 nm, preferably from 10 to 30 nm and a dispersion in an organic solvent such as an alcohol, a ketone or an ester, and commercial products thereof can be used.

The solid content of the colloidal silica in the outermost layer in the photoreceptor of the invention is not particularly limited. In view of a film formability, electrical characteristics and strengths, it is from 1 to 50% by weight, preferably from 5 to 30% by weight based on the total solid content of the outermost layer.

The silicone fine particles used as the silicon-containing fine particles in the invention are selected from silicone resin particles, silicone rubber particles and silicone surface-treated silica particles which are spherical and have an average particle diameter of, preferably from 1 to 500 nm, more preferably from 10 to 100 nm, and commercial fine particles are available.

The silicone fine particles are particles having a small diameter, chemically inactive and excellent in dispersibility in a resin. Further, since the content required to obtain satisfactory characteristics is low, a surface condition of the photoreceptor can be improved without impairing a crosslinking reaction. That is, the silicone fine particles which are uniformly incorporated in a tough crosslinked structure can improve a lubricity and a water repellency of the surface of the photoreceptor and maintain a good abrasion resistance and a good resistance to adhesion with a contaminant over a long period of time. The content of the silicone fine particles in the outermost layer in the photoreceptor of an electrophotographic system of the invention is from 0.1 to 20% by weight, preferably from 0.5 to 10% by weight based on the total solid content of the outermost layer.

Examples of other fine particles include fluorine-containing fine particles such as ethylene tetrafluoride, ethylene trifluoride, propylene hexafluoride, vinyl fluoride and vinylidene fluoride, and semiconducting metal oxides such as ZnO—$Al_2O_3$, $SnO_2$—$Sb_2O_3$, $In_2O_3$—$SnO_2$, ZnO—$TiO_2$, MgO—$Al_2O_3$, FeO—$TiO_2$, $TiO_2$, $SnO_2$, $In_2O_3$, ZnO, and MgO.

When the fine particles are incorporated in the photoreceptive layer in the ordinary photoreceptor of an electrophotographic system, the compatibility of the fine particles with the charge transport material and the binder resin tends to be unsatisfactory, and they induce layer separation in the photoreceptive layer to form an opaque film, whereby electrical characteristics are decreased. Meanwhile, in the invention, the specific cyclic siloxane compound and/or the derivatives thereof are incorporated to stably retain the fine particles in the photoreceptive layer, whereby good electrophotographic characteristics can be provided.

In the invention, it is possible to use additives such as a plasticizer, a surface modifier, an antioxidant and a photodeterioration inhibitor. Examples of the plasticizer include biphenyl, biphenyl chloride, terphenyl, dibutyl phthalate, diethylene glycol phthalate, dioctyl phthalate, triphenyl phosphate, methylnaphthalene, benzophenone, chlorinated paraffins, polypropylene, polystyrene and various fluorohydrocarbons.

Antioxidants having a hindered phenol, hindered amine, thioether or phosphate partial structure can be added to the resin layer of the invention, which is effective for improving a potential stability and an image quality in changing an atmosphere. Examples of the hindered phenol antioxidant include "Sumilizer BHT-R", "Sumilizer MDP-S", "Sumilizer BBM-S", "Sumilizer WX-R", "Sumilizer NW", "Sumilizer BP-76", "Sumilizer BP-101", "Sumilizer GA-80", "Sumilizer GM" and "Sumilizer GS" (made by Sumitomo Chemical Co., Ltd.), "IRGANOX 1010", "IRGANOX 1035", "IRGANOX 1076", "IRGANOX 1098", "IRGANOX 1135", "IRGANOX 1141", "IRGANOX 1222", "IRGANOX 1330", "IRGANOX 1425WL", "IRGANOX 1520L", "IRGANOX 245", "IRGANOX 259", "IRGANOX 3114", "IRGANOX 3790", "IRGANOX 5057" and "IRGANOX 565" (made by Ciba Specialities Chemicals), and "Adeka Stab AO-20", "Adeka Stab AO-30", "Adeka Stab AO-40", "Adeka Stab AO-50", "Adeka Stab AO-60", "Adeka Stab AO-70", "Adeka Stab AO-80" and "Adeka Stab AO-330" (made by Asahi Denka Co., Ltd.). Examples of the hindered amine antioxidant include "SANOL LS-2626", "SANOL LS-765", "SANOL LS-770" and "SANOL LS-744" (made by SNKYO CO., Ltd.), "Tinuvin 144" and "Tinuvin 622LD" (made by Ciba Specialities Chemicals), "Mark LA57", "Mark LA67", "Mark LA62", "Mark LA68" and "Mark LA63" (made by Asahi Denka Co., Ltd.), and "Sumilizer TPS" (made by Sumitomo Chemical Co., Ltd.). Examples of the thioether antioxidant include "Sumilizer TP-D" (made by Sumitomo Chemical Co., Ltd). Examples of the phosphite antioxidant include "Mark 2112", "Mark PEP-8", "Mark PEP-24G", "Mark PEP-36", "Mark 329K" and "Mark HP-10" (made by Asahi Denka Co., Ltd.). Of these, a hindered phenol antioxidant and a hindered amine antioxidant are especially preferable.

The compound in combination with the cyclic siloxane compound represented by formula (1) includes a compound represented by formula (5)

$$F^2(\text{-}D^2_e\text{-}OH)_f \quad (5)$$

wherein $F^2$ represents an organic group derived from a compound having a hole transportability, $D^2$represents a divalent organic group, e represents 0 or 1, and f represents an integer from 1 to 4 and derivatives derived from this compound.

Although the compound represented by formula (5) cannot singly be crosslinked, it can form a network crosslinked film by being reacted with a compound having plural isocyanate groups, preferably 3 or more isocyanate groups.

Specific examples of the isocyanate include polyisocyanates using monomers such as tolylene diisocyanate (TDI), diphenylmethane diisocyanate (MDI), 1,5-naphthylene diisocyanate, tolidine diisocyanate, 1,6-hexamethylene diisocyanate, xylene diisocyanate, lysine isocyanate, tetramethylxylene diisocyanate, 1,3,6-hexamethylene triisocyanate, lysine ester triisocyanate, 1,6,11-undecane triisocyanate, 1,8-diisocyanate-4-isocyanate methyloctane, triphenylmethane triisocyanate and tris(isocyanatephenyl) thiophosphate. In view of easy handling and a film formability and a cracking resistance of a finally obtained crosslinked film, modified substances of derivatives or prepolymers obtained from polyisocyanate monomers are preferably used. Especially preferable examples of such modified substances include a urethane modified substance obtained by modifying a polyol with an excess isocyanate compound, a biulet modified substance obtained by modifying a compound having a urea bond with an isocyanate compound and an allophanate modified substance with an isocyanate added to a urethane group. Further, an isocyanurate modified substance and a carbodiimide modified substance are also available. A blocked isocyanate obtained by reacting a blocking agent for temporarily masking an activity of an isocyanate group can also preferably be used.

Besides the isocyanate, the compound represented by formula (5) or the derivatives derived from the compound can be contained in the various silane coupling agents, the silane compound represented by formula (3) and the commercial silicon-containing hard coating agent.

Further, the fine particles such as the silicon-containing fine particles and the fluorine-containing fine particles, and additives such as a plasticizer, a surface modifier and an antioxidant can also be added.

Specific examples of the compound represented by formula (5) can include compounds represented by formulas (VI-1) to (VI-16).

(VI-1)

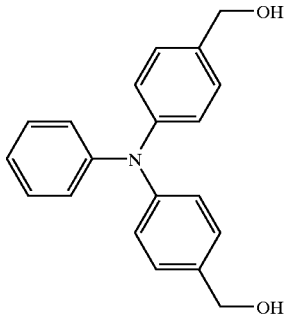

(VI-2)

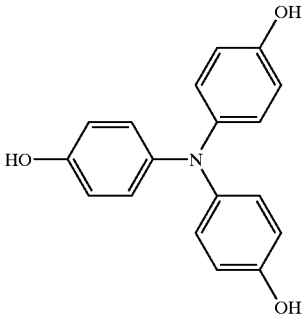

-continued (VI-3)

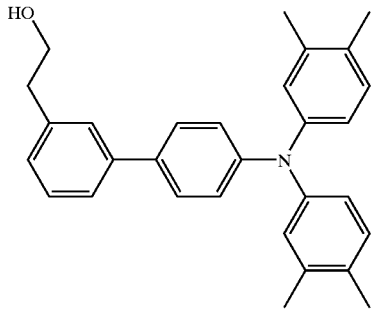

(VI-4)

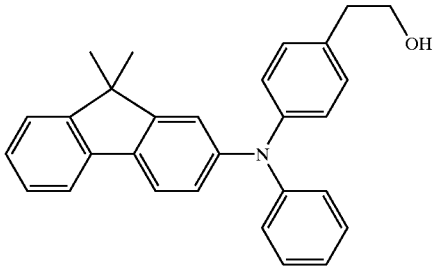

(VI-5)

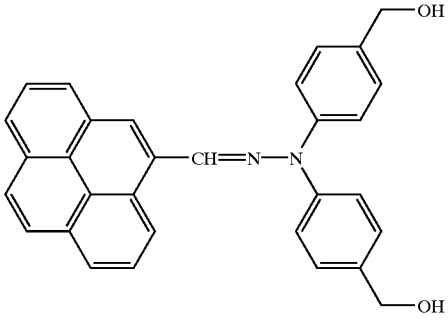

(VI-6)

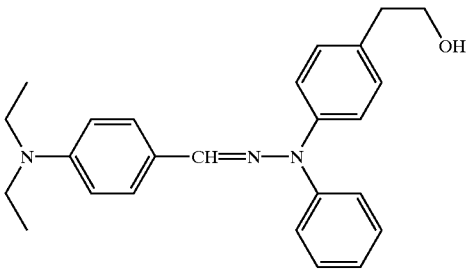

(VI-7)

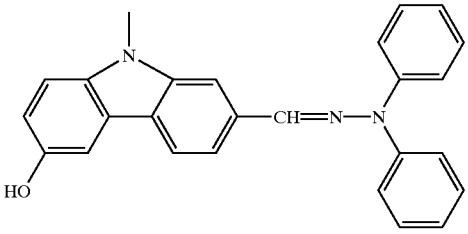

-continued (VI-8)

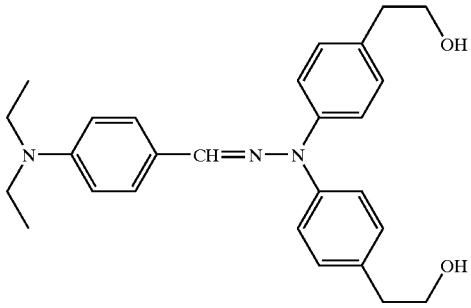

(VI-15)

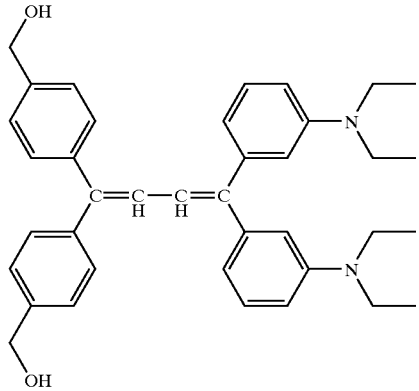

(VI-16)

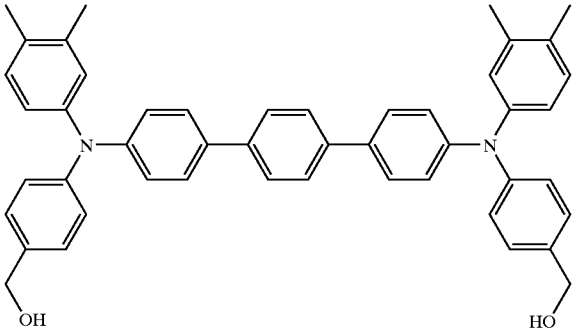

The thickness of the charge transport layer 14 is preferably from 5 to 50 $\mu$m, more preferably from 10 to 40 $\mu$m. When the thickness of the charge transport layer is less than 5 $\mu$m, electrification is difficult. Meanwhile, when it exceeds 50 $\mu$m, the electrophotographic characteristics tend to drastically decrease.

In the photoreceptor of an electrophotographic system shown in FIG. 1, the cyclic silicon compound and/or the derivatives thereof in the invention are incorporated in the charge transport layer 14 to satisfactorily increase photoelectric characteristics and mechanical strengths of the photoreceptor, whereby a resistance to contamination with a developer or corona products and a durability to a contact electrification unit or a cleaning blade can be improved. The use of the cyclic silicon compound and/or the derivatives thereof maintains the film formability of the charge transport layer 14 at a high level, making it possible to prevent occurrence of film defects in the production.

The photoreceptor of an electrophotographic system of the invention is not limited to the above-mentioned embodiment. For example, although the outermost layer (layer which is located remotest from the substrate 11) of the photoreceptor shown in FIG. 1 is the charge transport layer 14, a protective layer may further be formed on the charge transport layer 14 as an outermost layer. At this time, it is preferable that the protective layer contains the cyclic silicon compound of the invention, because the protective layer having high strengths can be formed. Moreover, the lubricity and the strengths can also be improved by incorporating silicone oil, a lubricant such as a fluorine-containing material and fine particles in the protective layer. Preferable examples of the lubricant can include the above-mentioned fluorine-containing silane coupling agents. Examples of the fine particles to be dispersed include the above-mentioned silicone fine particles and fluorine-containing fine particles, fine particles made of a resin obtained by copolymerizing a fluororesin with a hydroxyl-containing monomer as described in "8th *porima zairyo foramu koen yokoshu*, p. 89", and a semiconducting metal oxide. The thickness of the protective layer is preferably from 0.1 to 10 $\mu$m, more preferably from 0.5 to 7 $\mu$m.

The solvent used to form the protective layer is preferably a solvent which dissolves a material constituting the protective layer but does not attack the charge transport layer as a lower layer. Examples of the solvent include alcohols such as methanol, ethanol, propanol, isopropanol, butanol, t-butanol and cyclohexanol, ethers such as diethyl ether, dibutyl ether, dimethoxyethane and diethoxyethane, aromatic solvents such as xylene and p-cymene, cellosolves such as methyl cellosolve and ethyl cellosolve. Of these, alcohols boiling at from 60 to 150° C. are preferable in view of a film formability and a storage stability of a coating solution. As a coating method in forming the protective layer, an ordinary method such as a blade coating method, a Meyer bar coating method, a spray coating method, a dip coating method, a bead coating method, an air knife coating method or a curtain coating method can be used.

(Image Forming Apparatus and Process Cartridge)

Figure 2:
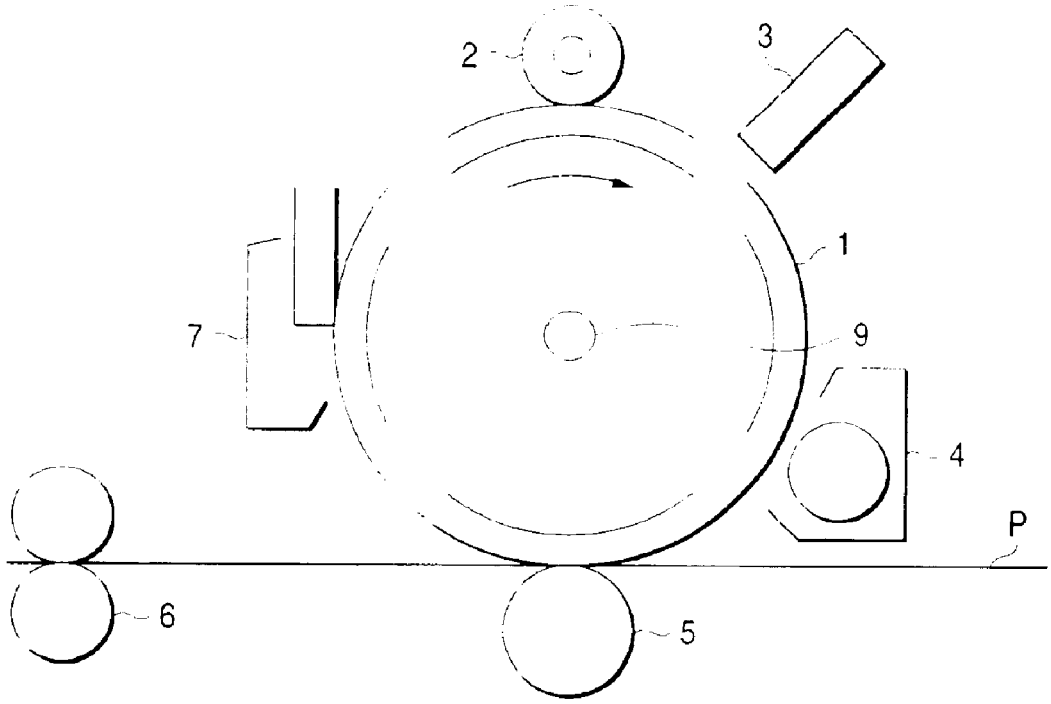
FIG. 2 is a diagrammatic view showing a preferable embodiment of an image forming apparatus of the invention.

FIG. 2 is a diagrammatic view showing a preferred embodiment of an image forming apparatus of the invention. In the apparatus shown in FIG. 2, the photoreceptor 1 shown in FIG. 1 is supported with a support 9, and adapted to be rotatable about the support 9 in an arrow direction at a predetermined rotational speed. An electrification unit 2, an exposure unit 3, a developing unit 4, a transfer unit 5 and a cleaning unit 7 are mounted in this order along the rotating direction of the photoreceptor 1. The apparatus has also an image fixing unit 6, and a transfer medium P is transported to the image fixing unit 6 via the transfer unit 5.

The electrification unit 2 may be a contact electrification type such as an electrification roller or a non-contact electrification type such as a corotron electrification unit. In view of prevention of ozonization, a contact electrification type is preferable.

As the exposure unit 3, an optical unit in which a desired image can be formed on the surface of the photoreceptor 1 can be employed by exposure to a light source such as a semiconductor laser, LED (light emitting diode) or a liquid crystal shutter. Especially, the use of an exposure unit capable of exposure to incoherent light can prevent occurrence of interference fringes between the substrate and the photoreceptive layer of the photoreceptor 1.

In the developing unit 4, a monocomponent developer or a two-component developer may be used, and the developer may be magnetic or non-magnetic. The developing unit 4 may be for a monochromic image or for a color image.

Examples of the transfer unit 5 include a contact transfer electrification unit using a belt, a roller, a film or a rubber blade, and a scorotron transfer electrification unit or a corotron transfer electrification unit using corona discharge.

The cleaning unit 7 is for removing a residual toner adhered to the surface of the photoreceptor 1 after the transfer step. The photoreceptor 1 surface-cleaned therewith can repetitively be subjected to the image forming process. As the cleaning unit 7, a cleaning blade, a cleaning brush and a cleaning roll can be used. Of these, a cleaning blade is preferable. Examples of a material of the cleaning blade include a urethane rubber, a neoprene rubber and a silicone rubber.

In the image forming apparatus shown in FIG. 2, the electrification, exposure, development, transfer and cleaning steps are repeatedly conducted during the rotation of the phototoreceptor 1 shown in FIG. 1. The photoreceptor 1 has the charge transport layer 14 as the silicon compound-containing layer containing the cyclic siloxane compound and/or the derivatives thereof in the invention, and is excellent in resistance to contamination with a developer or corona products and durability to a contact electrification unit or a cleaning blade. Consequently, a good image can be obtained with such an image forming apparatus over a long period of time.

This embodiment is not critical. For example, a process cartridge having the photoreceptor 1, the developing unit 4 and/or the cleaning unit 7 can be applied to the image forming apparatus shown in FIG. 2. The use of such a process cartridge allows easier maintenance. Since the invention attains outstanding life prolongation of the photoreceptor and the cleaning unit, the repeated use can be achieved by forming an inlet of a developer in the developing unit 4 of the process cartridge and replenishing a developer consumed.

In the apparatus shown in FIG. 2, a toner image formed on the surface of the photoreceptor 1 is directly transferred onto a transfer medium P. The image forming apparatus of the invention may further have an intermediate transfer member. In this case, the toner image on the surface of the photoreceptor 1 can be transferred onto the intermediate transfer member and then from the intermediate transfer member to the transfer medium P. As the intermediate transfer member, a member having a structure that an elastic layer containing a rubber, an elastomer or a resin and at least one coating layer are laminated on a conductive substrate can be used.

The invention can preferably be applied to not only a monochromatic image forming apparatus but also a color image forming apparatus. Examples of an output method of a color image include a method in which toner images of plural colors are formed on a photoreceptor and the respective toner images are transferred onto transfer paper, a method in which a toner image formed on a photoreceptor is transferred onto an intermediate transfer member and the toner image on the intermediate transfer member is further transferred onto transfer paper, and a method in which plural toner images are overlaid on a photoreceptor to form color toner images corresponding to the images and the color toner images are transferred at once.

EXAMPLES

The invention is illustrated more specifically below by referring to Examples and Comparative Examples. However, the invention is not limited thereto. In the following Examples and Comparative Examples, "part or parts" mean "part by weight or parts by weight" unless otherwise instructed.

Example 1

(Production of a Photoreceptor of an Electrophotographic System)

A coating solution for an undercoat layer made of 100 parts of a zirconium compound (trade name: Orgatics ZC540, made by Matsumoto chemical Industry Co., Ltd.), 10 parts of a silane compound (trade name: A1100, made by Nippon Unicar Co., Ltd.), 400 parts of isopropanol and 200 parts of butanol is prepared. This coating solution is dip-coated on a cylindrical Al substrate subjected to honing treatment, and heat-dried at 150° C. for 10 minutes to form an undercoat layer having a thickness of 0.1 μm.

Subsequently, 10 parts of chlorogallium phthalocyanine crystals having intense diffraction peaks at Bragg angles (2θ±0.2°) of 7.4°, 16.6°, 25.5° and 28.3° in an X-ray diffraction spectrum as a charge generation material is mixed with 10 parts of a polyvinyl butyral resin (trade name: S-LEC BM-S, made by Sekisui Chemical Co., Ltd.) and 1,000 parts of butyl acetate, and these are treated along with glass beads for 1 hour through a paint shaker for dispersion to obtain a coating solution for a charge generation layer. This coating solution is dip-coated on the undercoat layer, and heat-dried at 100° C. for 10 minutes to form a charge generation layer having a film thickness of approximately 0.15 μm.

Further, 20 parts of a benzidine compound represented by the following structural formula (34), 30 parts of a bisphenol (Z) polycarbonate resin (viscosity average molecular weight $4.4\times10^4$), 5 parts of 3-(3,3,3-trifluoropropyl) methylcyclotrisiloxane, 150 parts of monochlorobenzene and 150 parts of tetrahydrofuran are mixed to obtain a coating solution for a charge transport layer. This coating solution is dip-coated on the charge generation layer, and heat-dried at 115° C. for 1 hour to form a charge transport layer having a thickness of 20 μm. Thus, a desired photoreceptor is obtained.

(34)

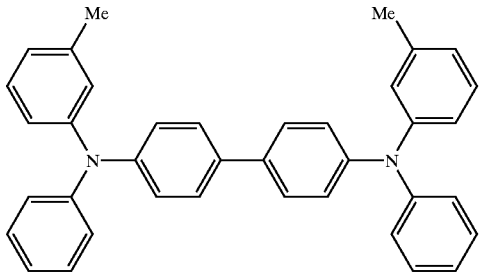

Example 2

An undercoat layer and a charge generation layer are formed as in Example 1.

Subsequently, 20 parts of the benzidine compound represented by formula (34), 30 parts of a bisphenol (Z) polycarbonate resin (viscosity average molecular weight $4.4\times10^4$), 150 parts of monochlorobenzene and 150 parts of tetrahydrofuran are mixed to form a coating solution. The coating solution is dip-coated on the charge generation layer, and heat-dried at 115° C. for 1 hour to form a charge transport layer having a thickness of 20 μm.

Further, molecular sieve 4A is added to 10 parts of a polysiloxane resin (containing 1% by weight of a silanol group) made of 80 mol % of a methylsiloxane unit and 20 mol % of a methylphenylsiloxane unit. The mixture is allowed to stand for 15 hours for dehydration. This resin is dissolved in 10 parts of toluene, and 5 parts of methyltrimethoxysilane, 5 parts of hexamethylcyclotrisiloxane and 0.2 part of dibutyltin acetate are added thereto to form a uniform solution. This solution is mixed with 6 parts of dihydroxymethyltriphenylamine (compound VI-1) and 1 part of an antioxidant (tradename: SANOL LS-2626, made by SANKYO CO., Ltd.) to obtain a coating solution for a protective layer. This coating solution is dip-coated on the charge transport layer, and heat-dried at 120° C. for 1 hour to form a protective layer having a thickness of 1 μm. Thus, a desired photoreceptor is obtained.

Example 3

A photoreceptor is produced as in Example 2 except that octamethylcyclotetrasiloxane is used instead of hexamethylcyclotrisiloxane.

Example 4

A photoreceptor is produced as in Example 2 except that decamethylcyclopentasiloxane is used instead of hexamethylcyclotrisiloxane.

Example 5

A photoreceptor is produced as in Example 2 except that 3-(3,3,3-trifluropropyl)methylcyclotrisiloxane is used instead of hexamethylcyclotrisiloxane.

Example 6

First, an undercoat layer, a charge generation layer and a charge transport layer are formed as in Example 2.

Subsequently, 20 parts of compound III-3 in Table 5, 30 parts of compound V-47 in Table 4, 5 parts of hexamethylcyclotrisiloxane, 20 parts of IPA (isopropyl alcohol) and 20 parts of ethanol are charged, and mixed well. To this mixture are added 2 parts of an ion exchange resin (tradename: Amberlist 15E, made by Rohm & Haas Co) and 25 parts of distilled water, and they are stirred at room temperature for 10 hours. Then, disappearance of compound V-47 is identified by TLC (thin layer chromatography, eluent: hexane/ethyl acetate≈3/1, adsorbent: silica gel). Thereafter, the ion exchange resin and a small amount of a precipitate are removed by filtration, and 0.5 part of aluminum trisacetylacetonate, 1 part of acetylacetone and 1 part of an antioxidant (trade name: Tinuvin 144, made by Ciba Specialities Chemicals) are added thereto. The resulting solution is dip-coated on the charge transport layer, and heat-dried at 130° C. for 1 hour to form a protective layer having a thickness of 3 μm. Thus, a desired photoreceptor of an electrophotographic system is obtained.

Example 7

A photoreceptor is produced as in Example 6 except that 10 parts of hydroxygallium phthalocyanine crystals having intense diffraction peaks at Bragg angles (2 θ±0.2°) of 7.5°, 9.9°, 12.5°, 16.3°, 18.6°, 25.1° and 28.3° in an X-ray diffraction spectrum as a charge generation material is used instead of chlorogallium phthalocyanine crystals.

Example 8

A photoreceptor is produced as in Example 6 except that 10 parts of titanium phthalocyanine crystals having an intense diffraction peak at a Bragg angle (2 θ±0.2°) of 27.3° in an X-ray diffraction spectrum as a charge generation material is used instead of chlorogallium phthalocyanine crystals.

Examples 9 to 30

Photoreceptors are produced as in Example 6 except that a charge transport material, a resin component, a cyclic siloxane compound and additives shown in Table 6 are used in forming a protective layer.

Examples 31 to 33

Photoreceptors are produced as in Example 6 except that a charge transport material, a resin component, a cyclic siloxane compound and additives shown in Table 6 are used in forming a protective layer and a coating solution obtained by treating a mixed solution containing them along with glass beads through a paint shaker for 0.5 hour for dispersion is used.

TABLE 6

| | Charge transport material | (parts) | Resin component (1) | (parts) | Resin Resin component (2) | (parts) | Cyclic compound | (parts) | Additive | (parts) | Additive | (parts) |
|---|---|---|---|---|---|---|---|---|---|---|---|---|
| Ex. 9 | V-47 | 30 | III-2 | 20 | | | octamethylcyclotetrasiloxane | 5 | Tinubin 144 | 1 | | |
| Ex. 10 | V-47 | 30 | III-2 | 20 | | | decamethylcyclopenta-siloxane | 5 | Tinubin 144 | 1 | | |
| Ex. 11 | V-47 | 30 | III-2 | 20 | | | 3-(3,3,3-trifluoropropyl) methylcyclotrisiloxane | 5 | Tinubin 144 | 1 | | |
| Ex. 12 | V-31 | 30 | III-2 | 20 | | | hexamethylcyclotrisiloxane | 5 | Sumilizer BHT-R | 1 | | |
| Ex. 13 | V-31 | 30 | III-2 | 20 | | | octamethylcyclotetrasiloxane | 5 | Sumilizer BHT-R | 1 | | |
| Ex. 14 | V-31 | 30 | III-2 | 20 | | | decamethylcyclopenta-siloxane | 5 | Sumilizer BHT-R | 1 | | |
| Ex. 15 | V-31 | 30 | III-2 | 20 | | | 3-(3,3,3-trifluoropropyl)-methylcyclotrisiloxane | 5 | Sumilizer BHT-R | 1 | | |
| Ex. 16 | V-31 | 30 | III-2 | 20 | | | 1,3,5-trimethyl-1,3,5-triphenylcyclotrisiloxane | 5 | Sumilizer BHT-R | 1 | | |
| Ex. 17 | V-31 | 30 | III-2 | 10 | $MeSi(OMe)_3$ | 10 | hexamethylcyclotrisiloxane | 5 | Sumilizer BHT-R | 1 | | |
| Ex. 18 | V-31 | 30 | III-10 | 10 | $Me2Si(OMe)_2$ | 10 | hexamethylcyclotrisiloxane | 5 | Sumilizer BHT-R | 1 | | |
| Ex. 19 | V-32 | 31 | III-3 | 20 | | | hexamethylcyclotrisiloxane | 5 | Adeka Stab LA-57 | 1 | | |
| Ex. 20 | V-32 | 32 | III-3 | 20 | | | hexamethylcyclotrisiloxane | 5 | Adeka Stab LA-52 | 1 | | |
| Ex. 21 | V-32 | 30 | III-3 | 20 | | | octamethylcyclotetrasiloxane | 5 | Sumilizer MDP-S | 1 | | |
| Ex. 22 | V-32 | 30 | III-3 | 20 | | | decamethylcyclopenta-siloxane | 5 | Sumilizer MDP-S | 1 | | |
| Ex. 23 | V-32 | 30 | III-3 | 20 | | | 3-(3,3,3-trifluoropropyl)-methylcyclotrisiloxane | 5 | Sumilizer MDP-S | 1 | | |
| Ex. 24 | V-15 | 30 | III-2 | 20 | | | hexamethylcyclotrisiloxane | 5 | Sumilizer BBM-S | 1 | | |
| Ex. 25 | V-7 | 30 | III-2 | 20 | | | hexamethylcyclotrisiloxane | 5 | Sanol LS765 | 1 | | |
| Ex. 26 | V-8 | 30 | III-3 | 20 | | | hexamethylcyclotrisiloxane | 5 | Sanol LS2626 | 1 | | |
| Ex. 27 | V-7 | 30 | III-3 | 20 | | | octamethylcyclotetrasiloxane | 5 | Sanol LS765 | 1 | | |
| Ex. 28 | V-8 | 30 | III-3 | 20 | | | octamethylcyclotetrasiloxane | 5 | Sanol LS2626 | 1 | | |
| Ex. 29 | V-32 | 30 | X40-2239 (Shin-etso Chemical) | 20 | | | hexamethylcyclotrisiloxane | 5 | Mark LA62 | 1 | | |
| Ex. 30 | V-15 | 30 | X40-2239 (Shin-etso Chemical) | 20 | | | hexamethylcyclotrisiloxane | 5 | Mark LA662 | 1 | | |
| Ex. 31 | V-32 | 30 | III-3 | 20 | | | 3-(3,3,3-trifluoropropyl)-methylcyclotrisiloxane | 5 | Sumilizer MDP-S | 1 | Rubron L2 (Dalkin Kogyo) | 5 |
| Ex. 32 | V-32 | 30 | III-3 | 20 | | | hexamethylcyclotrisiloxane | 5 | Sumilizer MDP-S | 1 | Tospearl XC99-A8808 (GE Toshiba Silicones) | 5 |
| Ex. 33 | V-32 | 30 | III-3 | 20 | | | hexamethylcyclotrisiloxane | 5 | Sumilizer MDP-S | 1 | R812 (AEROSIL) | 5 |

Comparative Example 1

A photoreceptor of an electrophotographic system is produced as in Example 1 except that 3-(3,3,3-trifluoropropyl)methylcyclotrisiloxane is not used.

Comparative Example 2

A photoreceptor is produced as in Example 6 except that hexamethylcyclotrisiloxane is not used.

Comparative Example 3

A photoreceptor is produced as in Example 6 except that 0.1 part of polydimethylsiloxane (trade name: DMS-T03, made by Chisso Corporation) is used instead of 5 parts of hexamethylcyclotrisiloxane.

Comparative Example 4

A photoreceptor is produced as in Example 6 except that 0.1 part of silanol-terminated polydimethylsiloxane (trade name: DMS-S12, made by Chisso Corporation) is used instead of 5 parts of hexamethylcyclotrisiloxane.

Comparative Example 5

A photoreceptor is produced as in Example 6 except that 0.1 part of epoxypropoxypropyl-terminated polydimethylsiloxane (trade name: DMS-E01, made by Chisso Corporation) is used instead of 5 parts of hexamethylcyclotrisiloxane.

Comparative Example 6

A photoreceptor is produced as in Example 1 except that a coating solution obtained by adding 5 parts of Rubron L2 (made by Daikin Kogyo Co., Ltd.) instead of 5 parts of 3-(3,3,3-trifluoropropyl)methylcyclotrisiloxane and treating the mixture along with glass beads through a paint shaker for 1 hour for dispersion is coated on a charge generation layer in forming a charge transport layer.

Comparative Example 7

A photoreceptor is produced as in Example 17 except that hexamethylcyclotrisiloxane is not used.

(Production of an Image Forming Apparatus and a Printing Test)

An image forming apparatus is produced using each of the photoreceptors in Examples 1 to 33 and Comparative Examples 1 to 7. The image forming apparatus is a color image forming apparatus having the same structure as Docu Centre Color 400 CP (manufactured by Fuji Xerox Co., Ltd.) except for the photoreceptor, and it has a developing unit using toners of four colors, yellow (Y), magenta (M), cyan (Y) and black (K), a contact electrification unit and a cleaning blade.

The printing test is then conducted using each of the resulting image forming apparatus to evaluate an initial image quality, an image quality after printing 10,000 sheets, a condition of the surface of the photoreceptor after printing 10,000 sheets and a condition of a cleaning blade after printing 10,000 sheets. In the printing test, an acid paper is used as a print paper, and two test conditions, normal temperature/normal humidity (approximately 20° C., 40% RH) and high temperature/high humidity (approximately 29° C., 85% RH), are employed. With respect to the condition of the surface of the photoreceptor after printing 10,000 sheets, evaluation is conducted on colors, yellow (Y), magenta (M), cyan (C) and black (K) according to the following criteria.

A: Neither scratch nor an adherent matter is observed.

B: Scratch is slightly observed.

C: An adherent matter is slightly observed.

D: Scratch is observed.

E: An adherent matter is observed.

F: Both scratch and an adherent matter are observed.

The results are shown in Tables 7 and 8.

TABLE 7

| | | Initial image quality | | Image quality after printing 10,000 sheets | | Surface condition of photoreceptor after printing 10,000 sheets | | | | | | | | Condition of cleaning blade after printing 10,000 sheets | |
|---|---|---|---|---|---|---|---|---|---|---|---|---|---|---|---|
| | | | | | | normal temp./normal humidity | | | | high temp./high humidity | | | | | |
| | Initial surface condition of photoreceptor | normal temp./normal humidity | high temp./high humidity | normal temp./normal humidity | high temp./high humidity | Y | M | C | K | Y | M | C | K | normal temp./normal humidity | high temp./high humidity |
| Ex. 1 | no problem | good | good | good | good | C | A | B | B | C | B | B | B | no problem | no problem |
| Ex. 2 | no problem | good | good | good | good | B | B | A | B | B | B | A | B | no problem | no problem |
| Ex. 3 | no problem | good | good | good | good | A | C | A | B | A | C | A | B | no problem | no problem |
| Ex. 4 | no problem | good | good | good | good | A | C | A | B | A | C | A | B | no problem | no problem |
| Ex. 5 | no problem | good | good | good | good | B | B | A | B | B | B | A | B | no problem | no problem |
| Ex. 6 | no problem | good | good | good | good | A | C | A | C | A | C | A | C | no problem | no problem |
| Ex. 7 | no problem | good | good | good | good | A | C | A | C | A | C | A | C | no problem | no problem |
| Ex. 8 | no problem | good | good | good | good | A | C | A | C | A | C | A | C | no problem | no problem |
| Ex. 9 | no problem | good | good | good | good | A | A | A | A | A | A | A | B | no problem | no problem |
| Ex. 10 | no problem | good | good | good | good | A | A | A | A | A | A | A | B | no problem | no problem |
| Ex. 11 | no problem | good | good | good | good | A | A | A | A | A | A | A | A | no problem | no problem |
| Ex. 12 | no problem | good | good | good | good | A | A | A | A | A | A | A | B | no problem | no problem |
| Ex. 13 | no problem | good | good | good | good | A | A | A | A | A | A | A | B | no problem | no problem |
| Ex. 14 | no problem | good | good | good | good | A | A | A | A | A | A | A | B | no problem | no problem |
| Ex. 15 | no problem | good | good | good | good | A | A | A | A | A | A | A | B | no problem | no problem |
| Ex. 16 | no problem | good | good | good | good | A | A | A | A | A | A | A | B | no problem | no problem |
| Ex. 17 | no problem | good | good | good | good | A | B | A | B | A | A | A | B | no problem | no problem |
| Ex. 18 | no problem | good | good | good | good | A | B | A | B | A | A | A | B | no problem | no problem |
| Ex. 19 | no problem | good | good | good | good | A | A | A | B | A | A | A | A | no problem | no problem |
| Ex. 20 | no problem | good | good | good | good | A | A | A | B | A | A | A | A | no problem | no problem |

TABLE 8

| | Initial surface condition of photoreceptor | Initial image quality | | Image quality after printing 10,000 sheets | | Surface condition of photoreceptor after printing 10,000 sheets | | | | | | | | Condition of cleaning blade after printing 10,000 sheets | |
|---|---|---|---|---|---|---|---|---|---|---|---|---|---|---|---|
| | | normal temp./ normal humidity | high temp./ high humidity | normal temp./ normal humidity | high temp./ high humidity | normal temp./ normal humidity | | | | high temp./ high humidity | | | | normal temp./ normal humidity | high temp./ high humidity |
| | | | | | | Y | M | C | K | Y | M | C | K | | |
| Ex. 21 | no problem | good | good | good | good | A | A | A | B | A | A | A | A | no problem | no problem |
| Ex. 22 | no problem | good | good | good | good | A | A | A | B | A | A | A | A | no problem | no problem |
| Ex. 23 | no problem | good | good | good | good | A | A | A | B | A | A | A | A | no problem | no problem |
| Ex. 24 | no problem | good | good | good | good | A | A | A | B | A | A | A | B | no problem | no problem |
| Ex. 25 | no problem | good | good | good | good | A | A | A | B | A | A | A | B | no problem | no problem |
| Ex. 25 | no problem | good | good | good | good | A | A | A | B | A | A | A | B | no problem | no problem |
| Ex. 27 | no problem | good | good | good | good | A | A | A | B | A | A | A | B | no problem | no problem |
| Ex. 21 | no problem | good | good | good | good | A | B | A | B | A | B | A | B | no problem | no problem |
| Ex. 29 | no problem | good | good | good | good | A | B | A | B | A | B | A | B | no problem | no problem |
| Ex. 30 | no problem | good | good | good | good | A | A | A | A | A | A | A | A | no problem | no problem |
| Ex. 31 | no problem | good | good | good | good | A | A | A | A | A | A | A | A | no problem | no problem |
| Ex. 32 | no problem | good | good | good | good | A | A | A | A | A | A | A | A | no problem | no problem |
| Comp. Ex. 1 | no problem | good | good | Good | slight image deletion | B | D | D | D | D | D | D | D | no problem | no problem |
| Comp. Ex. 2 | no problem | good | good | Good | slight streak | C | E | C | E | E | E | C | E | no problem | slight streak |
| Comp. Ex. 3 | no problem | good | good | Good | slight streak | C | E | C | E | C | E | C | E | no problem | no problem |
| Comp. Ex. 4 | no problem | good | good | Good | slight streak | E | E | C | E | E | E | C | E | no problem | no problem |
| Comp. Ex. 5 | no problem | good | good | Good | slight streak | C | E | C | E | C | E | C | E | no problem | no problem |
| Comp. Ex. 6 | many film defects | good | good | Good | slight image deletion | B | D | B | D | B | D | B | D | no problem | no problem |
| Comp. Ex. 7 | no problem | good | good | Good | slight streak | C | E | C | E | E | E | C | E | no problem | no problem |

As is clear from the results shown in Tables 7 and 8, in the image forming apparatus having the photoreceptors in Examples 1 to 33, it is identified that the image quality, the surface condition of the photoreceptor and the condition of the cleaning blade are good even after printing 10,000 sheets.

As has been thus far described, the invention provides the photoreceptor of an electrophotographic system satisfactorily high in resistance to contamination with a developer or corona products and durability to a contact electrification unit or a cleaning blade and capable of preventing occurrence of film defects in the production, as well as the process cartridge and the image forming apparatus in which the good image quality can be obtained over a long period of time.

The entire disclosure of Japanese Patent Application No. 2002-121272 filed on Apr. 23, 2002 including specification, claims, drawings and abstract is incorporated herein by reference in its entity.

What is claimed is:

1. A photoreceptor of an electrophotographic system, comprising:

a conductive substrate; and a siloxane compound-containing layer located over the substrate and containing at least one of a cyclic siloxane compound and a derivative thereof, the cyclic siloxane compound having a cyclic structure represented by formula (7)

(7)

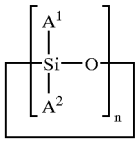

wherein $A^1$ and $A^2$, which may be the same or different, each represents a monovalent organic group, and n is an integer.

2. The photoreceptor claimed in claim 1, wherein at least one of $A^1$ and $A^2$ in formula (1) has at least one of a fluorine atom and a cyclic substituent.

3. The photoreceptor claimed in claim 1, wherein the siloxane containing-compound layer further contains a charge transport material.

4. The photoreceptor claimed in claim 1, wherein the siloxane containing-compound layer further contains at least one of a resin and a resin precursor.

5. The photoreceptor as claimed in claim 4, wherein the resin is a polycarbonate resin.

6. The photoreceptor as claimed in claim 1, wherein the siloxane compound containing layer contains at least one of:

the cyclic siloxane compound;

a ring-opening polymer of the cyclic siloxane compound;

a complex of the cyclic siloxane compound and the charge transport material; and a complex of the cyclic siloxane compound and the resin or the resin precursor.

7. The photoreceptor as claimed in claim 1, wherein the siloxane compound-containing layer contains at least one of polycarbonate, a methacrylic resin, an acrylic resin, and an organosilicon compound or its hydrolyzate or hydrolytic condensate.

8. The photoreceptor as claimed in claim 1, wherein the siloxane compound-containing layer contains at least one of an organosilicon compound and its hydrolyzate or hydrolytic condensate, the organosilicon compound being represented by formula (2) or (3):

$$SiQ^1_aR^1_{3-a} \quad (2)$$

wherein $R^1$ represents one selected from the group consisting of a hydrogen atom, an alkyl group, a fluoroalkyl group and a substituted or unsubstituted aryl group, $Q^1$ represents a hydrolyzable group, and a represents an integer from 1 to 3;

$$B(—SiQ^2_bR^2_{3-b})_2 \quad (3)$$

wherein $R^2$ represents one selected from the group consisting of a hydrogen atom, an alkyl group, a fluoroalkyl group and a substituted or unsubstituted aryl group, $Q^2$ represents a hydrolyzable group, B represents a divalent organic group, and b represents an integer from 1 to 3.

9. The photoreceptor as claimed in claim 1, wherein the siloxane compound-containing layer contains at least a charge transport material represented by formula (4) or (5):

$$F^1(\text{-}D^1\text{-}SiQ^3_cR^3_{3-c})_d \quad (4)$$

wherein $F^1$ represents an organic group derived from a compound having a hole transportability, $R^3$ represents one selected from the group consisting of a hydrogen atom, an alkyl group, a fluoroalkyl group and a substituted or unsubstituted aryl group, $D^1$ represents a divalent group, $Q^3$ represents a hydrolyzable group, c represents an integer from 1 to 3, and d represents an integer from 1 to 4;

$$F^2(\text{-}D^2_e\text{-}OH)_f \quad (5)$$

wherein $F^2$ represents an organic group derived from a compound having a hole transportability, $D^2$ represents a divalent organic group, e represents 0 or 1, and f represents an integer from 1 to 4.

10. The photoreceptor as claimed in claim 1, wherein the siloxane compound-containing layer contains the charge transport material represented by formula (4), and organic group $F^1$ of the charge transport material is represented by formula (6):

(6)

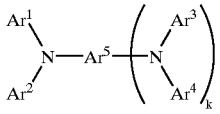

wherein $Ar^1$, $Ar^2$, $Ar^3$ and $Ar^4$, which may be the same or different, each represents a substituted or unsubstituted aryl group, $Ar^5$ represents a substituted or substituted aryl group or arylene group, and k represents 0 or 1, provided at least one of $Ar^1$ to $Ar^5$ has a bonding site with $\text{-}D^1\text{-}SiQ^3_cR^3_{3-c}$ in formula (4).

11. The photoreceptor as claimed in claim 1, wherein the siloxane compound-containing layer is cured.

12. The photoreceptor as claimed in claim 1, wherein the siloxane compound-containing layer further contains at least one finely divided component.

13. A process cartridge comprising:

a photoreceptor of an electrophotographic system, comprising a conductive substrate and a siloxane compound-containing layer located over the substrate and containing at least one of a cyclic siloxane compound and a derivative thereof, the cyclic siloxane compound having a cyclic structure represented by formula (7)

(7)

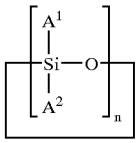

wherein $A^1$ and $A^2$, which may be the same or different, each represents a monovalent organic group, and n represents an integer; and at least one of a developing unit which develops an electrostatic latent image formed on the photoreceptor to form a toner image and a cleaning unit which removes a toner remaining on the photoreceptor after transferring the toner image.

14. The process cartridge as claimed in claim 13, wherein the cleaning unit has a blade.

15. An image forming apparatus comprising a photoreceptor of an electrophotographic system, comprising a conductive substrate and a siloxane compound-containing layer located over the substrate and containing at least one of a cyclic siloxane compound and a derivative thereof, the cyclic siloxane compound having a cyclic structure represented by formula (7)

(7)

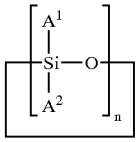

wherein $A^1$ and $A^2$, which may be the same or different, each represents a monovalent organic group, and n represents an integer;

an electrification unit which electrifies the photoreceptor;

an exposure unit which exposes the electrified photoreceptor to form an electrostatic latent image;

a developing unit which develops the electrostatic latent image to form a toner image;

a transfer unit which transfers the toner image onto a transfer medium; and a cleaning unit which removes a toner remaining on the photoreceptor after transferring the toner image.

16. The image forming apparatus as claimed in claim 15, wherein the cleaning unit has a blade.

* * * * *